US006312096B1

(12) United States Patent
Koitabashi et al.

(10) Patent No.: US 6,312,096 B1
(45) Date of Patent: Nov. 6, 2001

(54) INK-JET PRINTING METHOD AND APPARATUS

(75) Inventors: Noribumi Koitabashi, Yokohama; Osamu Iwasaki, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/099,868

(22) Filed: Jun. 19, 1998

(30) Foreign Application Priority Data

Jun. 19, 1997 (JP) ..... 9-163035

(51) Int. Cl.[7] ..... B41J 2/15
(52) U.S. Cl. ..... 347/40; 347/43; 347/56
(58) Field of Search ..... 347/40, 43, 48, 347/62, 9, 10, 12, 56, 65

(56) References Cited

U.S. PATENT DOCUMENTS

| | | | | |
|---|---|---|---|---|
| 4,222,060 | | 9/1980 | Sato et al. | 347/9 |
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/47 |
| 4,558,333 | | 12/1985 | Sugitani et al. | 347/65 |
| 4,723,129 | | 2/1988 | Endo et al. | 347/56 |
| 4,740,796 | | 4/1988 | Endo et al. | 347/56 |
| 5,111,302 | * | 5/1992 | Chan et al. | 347/43 |
| 5,371,531 | * | 12/1994 | Rezanka et al. | 347/43 |
| 5,488,398 | * | 1/1996 | Matsubara et al. | 347/43 |
| 5,610,637 | * | 3/1997 | Sekiya et al. | 347/10 |
| 5,731,828 | * | 3/1998 | Ishinaga et al. | 347/62 |
| 5,949,451 | * | 9/1999 | Takagi | 347/43 |

FOREIGN PATENT DOCUMENTS

| | | |
|---|---|---|
| 0 115 180 | 8/1984 | (EP) . |
| 0 737 586 | 10/1996 | (EP) . |
| 59-123670 | 7/1984 | (JP) . |
| 59-138461 | 8/1984 | (JP) . |
| WO 95/11807 | 5/1995 | (WO) . |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

Disclosed are an ink-jet printing method and apparatus for jetting ink successively from nozzles of an ink-jet head at a prescribed frequency and forming each of a number of pixels by a plurality of dots conforming to the tone of the pixel. Each nozzle of the ink-jet head has a heater A and a heater B. Printing is performed by changing the number of heaters actuated to jet an ink drop, thereby to control the formation of a large or small dot by each nozzle, and by changing the method of driving the heaters A and B in dependence upon the density of the ink used. In regard to the timings at which the large and small dots are formed by each nozzle, the small dot is formed first. As a result, the large and small dots can be made to overlap so that an image having excellent tone reproducibility can be printed.

27 Claims, 23 Drawing Sheets

| | DRIVING PULSE WAVEFORMS FOR RECORDING LARGE DOT | DRIVING PULSE WAVEFORMS FOR RECORDING SMALL DOT | V1 | V2 | FREQUENCY OF DRAWING f (kHz) | $F \cdot L \cdot \frac{V1-V2}{V1\,V2}$ |
|---|---|---|---|---|---|---|
| ORDINARY CARTRIDGE | HEATER A<br>HEATER B | HEATER A<br>HEATER B | 14.5mm/s | 8.5mm/s | 6.5kHz | 0.47 |
| PHOTO CARTRIDGE | HEATER A<br>HEATER B | HEATER A<br>HEATER B | 13mm/s | 7mm/s | 6.5kHz ↓ 5.2kHz | 0.64 ↓ 0.51 |

FIG. 12

| | DRIVING PULSE WAVEFORMS FOR RECORDING LARGE DOT | DRIVING PULSE WAVEFORMS FOR RECORDING SMALL DOT | V1 | V2 | FREQUENCY OF DRAWING f (kHz) | $F \cdot L \cdot \frac{V1-V2}{V1\ V2}$ |
|---|---|---|---|---|---|---|
| ORDINARY CARTRIDGE | HEATER A<br>HEATER B | HEATER A<br>HEATER B | 14.5mm/s | 8.5mm/s | 6.5kHz | 0.47 |
| PHOTO CARTRIDGE | HEATER A<br>HEATER B | HEATER A<br>HEATER B | 13mm/s | 7mm/s | 6.5kHz ↓ 5.2kHz | 0.64 ↓ 0.51 |

FIG. 17

| 2-BIT INPUT | DECODED OUTPUT | |
|---|---|---|
| 00 | × | × |
| 01 | × | ○ |
| 10 | ○ | × |
| 11 | ○ | ○ |

INK-JET PRINTING METHOD AND APPARATUS

BACKGROUND OF THE INVENTION

This invention relates to an ink-jet printing method and apparatus for performing printing by jetting ink onto a recording medium from a print head.

A recording apparatus such as a printer, copier or facsimile machine is adapted to form dots on a recording medium such as paper or thin plastic sheets by individual recording elements (nozzles, heating elements or wires, etc.), thereby printing an image comprising the dots. Such a recording apparatus can be classified, depending on the recording technique used, as an apparatus of ink-jet type, wire dot type, thermal type or laser beam type, etc. Among these, the apparatus of the ink-jet type (referred to as an ink-jet printer) is so adapted as to jet ink (the recording fluid) from the nozzles of a print head and cause the jetted ink to adhere to a recording medium to thereby form an image on the medium.

A number of studies have been made for the purpose of improving the tonality of a color graphics output when printing a color image using such an ink-jet printer. For example, an improvement proposed and put into practice in recent years involves either raising print performance by making printing resolution higher than that of an ordinary color printing mode or raising the resolution of the printing apparatus, sending multilevel image data to the printing apparatus as print data and providing a multilevel printout using dots of a size different from the ordinary dot size. (The dots of the different size are referred to as "subpixels".)

An example of a method using subpixels is one which prints an image using mixed dots, namely dots of large and small size. Such a printing method makes it possible to improve tone reproducibility in image formation. However, though this method can be implemented with ease if the number of nozzles possessed by the ink-jet head is one per color, control becomes very complex if use is made of a head having a plurality of nozzles for each color.

In order for each nozzle to jet ink, the nozzle ordinarily is driven at a frequency above several kilohertz. Though direct control by a CPU is possible if the number of nozzles possessed by a head is small, it becomes increasingly necessary in view of processing speed to make joint use of hardware circuitry such as a gate array as the number of nozzles is increased. Further, if the amount of ink jetted from the nozzles is to be modulated to form large and small dots, this is carried out by changing the width of the driving pulses for ink discharge or by changing over the timing at which the driving elements within the nozzle are driven to discharge the ink. If drive timing is changed over, it is required that the head be internally provided with two drive-data registers per nozzle, one register being for large dots and one for small dots. If the number of nozzles is increased, the number of registers also increases by a whole-number multiple. The end result is print head circuitry of large scale and an attendant increase in the cost of the print head.

The method of changing the driving pulse width requires the provision of individual signal lines in order to control the nozzles individually. Consequently, the single signal line that usually suffices becomes several hundred signal lines (which is equivalent to the number of nozzles). This makes necessary an equivalent number of contacts between the head and its cable, an equivalent number of lines in the flexible cable leading to the print head and an equivalent number of driver transistors for the recording elements. This in turn leads to much higher cost.

If one foregoes printing by mixing large and small dots by way of single scan of a serial print head, then printing is carried out by causing the print head to make a plurality of scans (multiple passes) and combining scans which form large dots and scans which form small dots. Such method makes it possible to print by mixing large and small dots in an image through a simple arrangement. However, since this method always requires plural scans of the print head, a longer period of time is needed for printing.

Further, in a situation where pixels are thus formed using large and small dots, it is desirable to form the pixels by causing the large and small dots to overlap. However, a problem which arises is that the large and small dots are formed at positions offset from one another. This causes the image to take on a grainy appearance owing to small dots formed in spaced-apart relation and results in the appearance of white stripes.

SUMMARY OF THE INVENTION

Accordingly, an object of the present invention is to provide an ink-jet printing method and apparatus through which a pixel can be printed by a plurality of dots conforming to the tone of the pixel using a simple arrangement and simple control.

Another object of the present invention is to provide an ink-jet printing method and apparatus for modulating the amount of jetted ink in order to jet ink for forming dots of different diameters, and printing an image by a plurality of dots whose diameters conform to the levels of multilevel print data.

A further object of the present invention is to provide an ink-jet printing method and apparatus capable of printing dots conforming to the tones of printed pixels without reducing printing speed.

Yet another object of the present invention is to provide an ink-jet printing method and apparatus through which it is possible to form an image in which the occurrence of graininess and white stripes is suppressed by forming pixels using overlapping dots of large and small diameters to form the pixels.

According to the present invention, the foregoing objects are attained by providing an ink-jet printing apparatus in which ink jetted from an ink nozzle of a print head is made to adhere to a recording medium to form a pixel on the recording medium by the adhered ink, comprising:

scanning means for scanning the print head, which has a plurality of the ink nozzles, in a main-scan direction; and drive means, provided in correspondence with each nozzle of the print head, capable of successively jetting at least two inks of mutually different velocities from the ink nozzles at prescribed timings in synchronization with scanning of the print head by the scanning means in order to form the pixel from a plurality of dots; wherein distance between the ink nozzles and the recording medium, the prescribed timings at which the at least two inks are jetted and the velocities at which the at least two inks are jetted are controlled so as to satisfy a predetermined relationship in order that the at least two inks successively jetted from the print head by the drive means at the prescribed timings will adhere to the recording medium within the pixel.

Further, the foregoing objects are attained by providing an ink-jet printing method in which ink jetted from an ink nozzle of a print head is made to adhere to a recording medium to form a pixel on the recording medium by the adhered ink, comprising: a scanning step of scanning the print head in a main-scan direction; and a drive step of successively jetting at least two inks of mutually different velocities from the ink nozzles of the print head at prescribed timings in synchronization with scanning of the print head in order to form a plurality of dots which form the pixel; wherein distance between the ink nozzles and the recording medium, the prescribed timings at which the at least two inks are jetted and the velocities at which the at least two inks are jetted are controlled so as to satisfy a predetermined relationship in order that the at least two inks successively jetted from the print head by the drive step at the prescribed timings will adhere to the recording medium within the pixel.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 12 is a diagram useful in describing examples of head drive conforming to the type of cartridge (ink) in an embodiment of the invention;

FIG. 17 is a diagram for describing an example of outputs obtained by decoding 2-bit print data;

DESCRIPTION OF THE PREFERRED EMBODIMENTS

Preferred embodiments of the present invention will now be described with reference to the accompanying drawings. In the description, the word "record" means to form an image of not only characters, symbols or figures, but image patterns on a recording medium.

Figure 1:
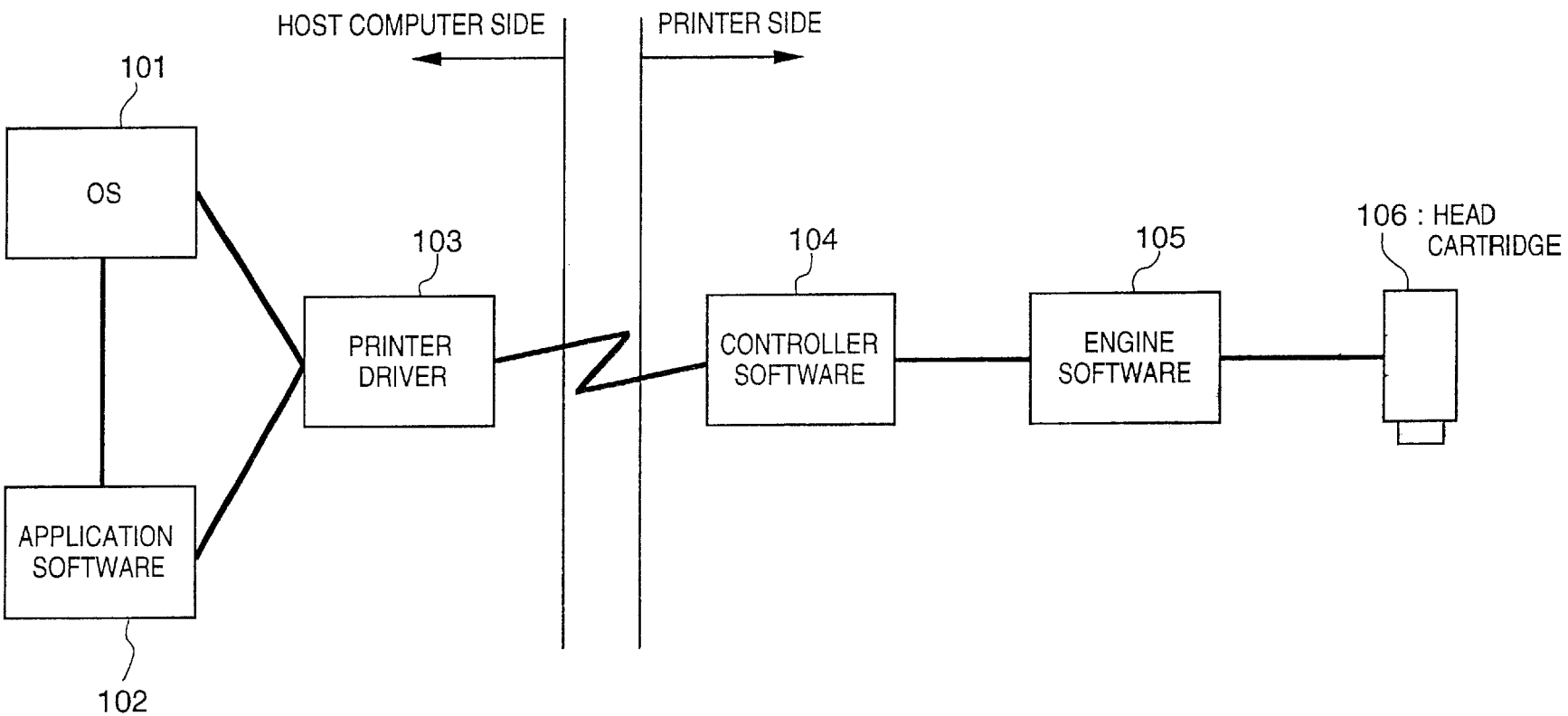
FIG. 1 is a block diagram illustrating the configuration of a printing system which includes a host computer and a printing apparatus according to an embodiment of the present invention.

FIG. 1 is a block diagram illustrating the configuration of a printing system according to an embodiment of the present invention.

As shown in FIG. 1, the host computer side of the system generally is arranged to execute the processing of various data using application software 102 that runs on the operating system (OS) 101. The flow of data will be described for a case where image data that has been created using the application software 102, which is for handling pictorial images, is output to a printing apparatus via a printer driver 103 so that the image may be printed by the printing apparatus.

When the image data created and processed by the application software 102 is pictorial data, the data is sent to the printer driver 103 as multilevel RGB data. The printer driver 103 applies color processing to the multilevel RGB data received from the application software 102, then subjects the results to halftone processing to effect a conversion to data that is usually bilevel CMYK data. The image data thus converted is output via a printer interface in the host computer or via an interface leading to a storage device which stores files and the like. In the arrangement shown in FIG. 1, the image data is output to the printing apparatus via an interface that leads to the printing apparatus.

Under the control of controller software 104, the printing apparatus receives the image data, checks to determine whether the printing mode, ink-jet cartridge and the like are appropriate and delivers the received image data to engine software 105. The engine software 105 accepts the received image data in the printing mode and data structure specified by the controller software 104, generates ink jetting pulses based upon this image data and outputs the pulses to a head cartridge 106. As a result, the head cartridge 106 jets the inks of the corresponding colors to print a color image conforming to this image data on the recording medium. It should be noted that the head cartridge 106 is constructed as an integrated body comprising ink tanks containing inks of the respective colors and a print head.

Figure 2:
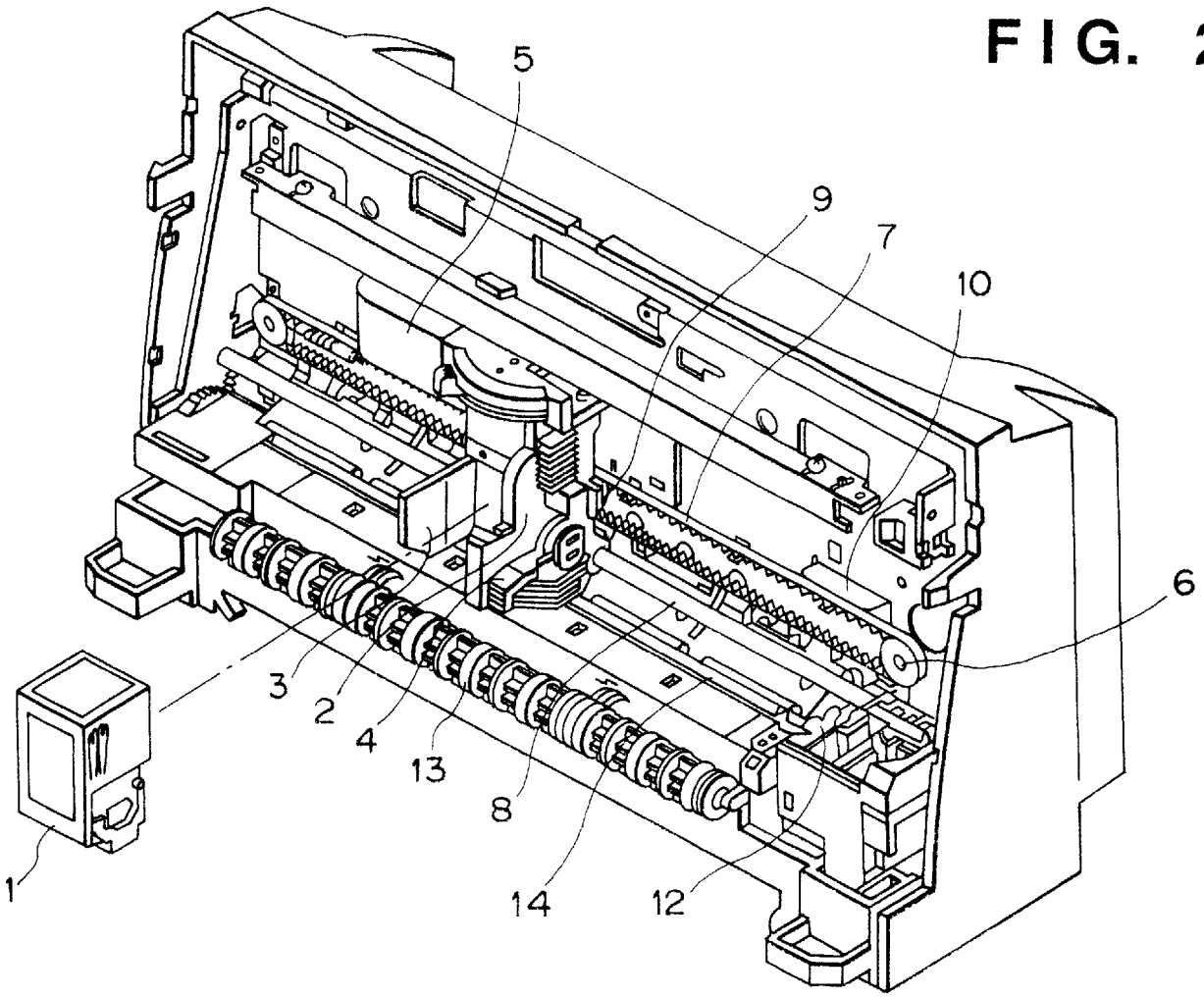
FIG. 2 is a perspective view showing the external appearance of the recording section of an ink-jet printing apparatus according to this embodiment.

FIG. 2. is a diagram showing the mechanical structure of a replaceable-cartridge-type ink-jet printing apparatus according to an embodiment of the invention. Here the front cover of the ink-jet printing apparatus has been removed to reveal the interior of the apparatus.

The apparatus includes a replaceable head cartridge 1 (which corresponds to the head cartridge 106 in FIG. 1). The head cartridge 1 is equipped with an ink tank section containing ink and a print head. A carriage unit 2 has the head cartridge 1 attached thereto and moves the head cartridge 1 to the left and right to perform printing. A holder 3 is for securing the head cartridge 1 and operates in association with a cartridge fixing lever 4. More specifically, after the head cartridge 1 is mounted in the carriage unit 2, the cartridge fixing lever 4 is operated to fixedly secure the head cartridge 1 to the carriage unit 2. This positions the head cartridge 1 and establishes electrical contact between the head cartridge 1 and the carriage unit 2. A flexible cable 5 sends electrical signals to the carriage unit 2. A carriage motor 6 is rotated to move the carriage unit 2 back and forth in the main-scan direction. A carriage belt 7 is driven into movement by the carriage motor 6 to move the carriage unit 2 leftward and rightward. A guide shaft 8 supports the carriage unit 2 so that the carriage unit 2 is capable of sliding. A home position sensor 9 has a photocoupler for deciding the home position of the carriage unit 2. A light shield 10 is for detecting the home position. When the carriage unit 2 arrives at the home position, the light shield 10 cuts off the light impinging upon the photocoupler provided on the carriage unit 2, whereby the fact that the carriage unit 2 has arrived at the home position is sensed. A home position unit 12 includes a recovery mechanism for the print head of the head cartridge 1. A paper discharge roller 13 is for discharging the recording medium (recording paper, etc.). The recording medium is grasped by the discharge roller 13 and spurs (not shown) so as to be discharged from the printing apparatus. An LF (line feed) unit 14 transports the recording medium a determined amount in the sub-scan direction.

Figure 3:
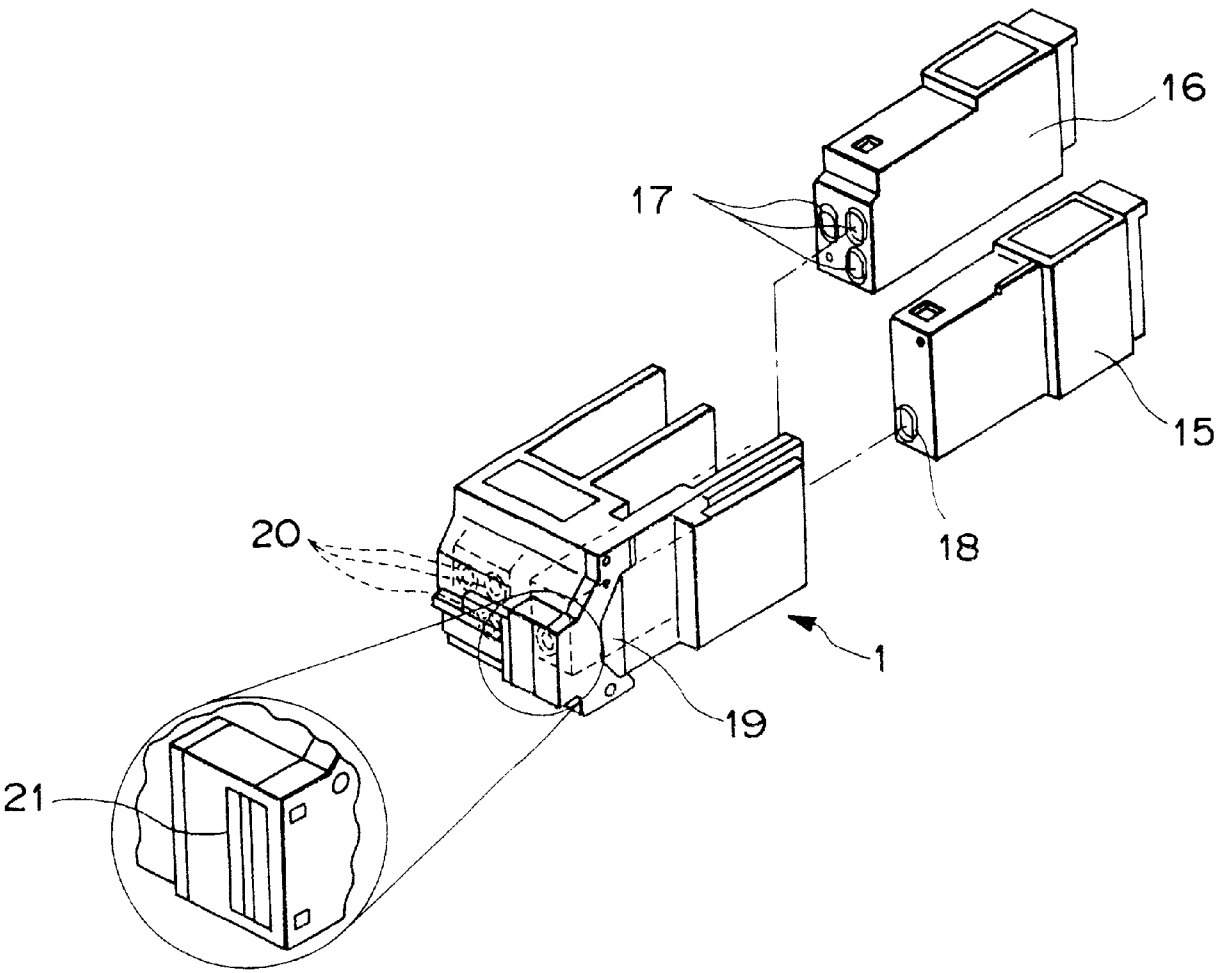
FIG. 3 is a perspective view showing the construction of a head cartridge according to this embodiment.

FIG. 3 is a detailed view of the head cartridge 1 used in this embodiment of the invention. The head cartridge 1 includes a replaceable ink tank 15 for the color black (Bk), and a replaceable ink tank 16 containing inks serving as C, M andY colorants. The ink tank 16 has ports (colorant supply ports) 17 connected to the head cartridge 1 to supply the inks. The ink tank 15 has a port (ink supply port) 18 connected to the head cartridge 1 to supply the ink. The ink supply ports 17, 18 are connected to supply tubes 20 to supply a print head section 21 with the inks. A contact portion 19 for electrical signals is connected to the flexible cable 5 (see FIG. 2) so that various signals may be sent to the head cartridge 1.

Figure 4:
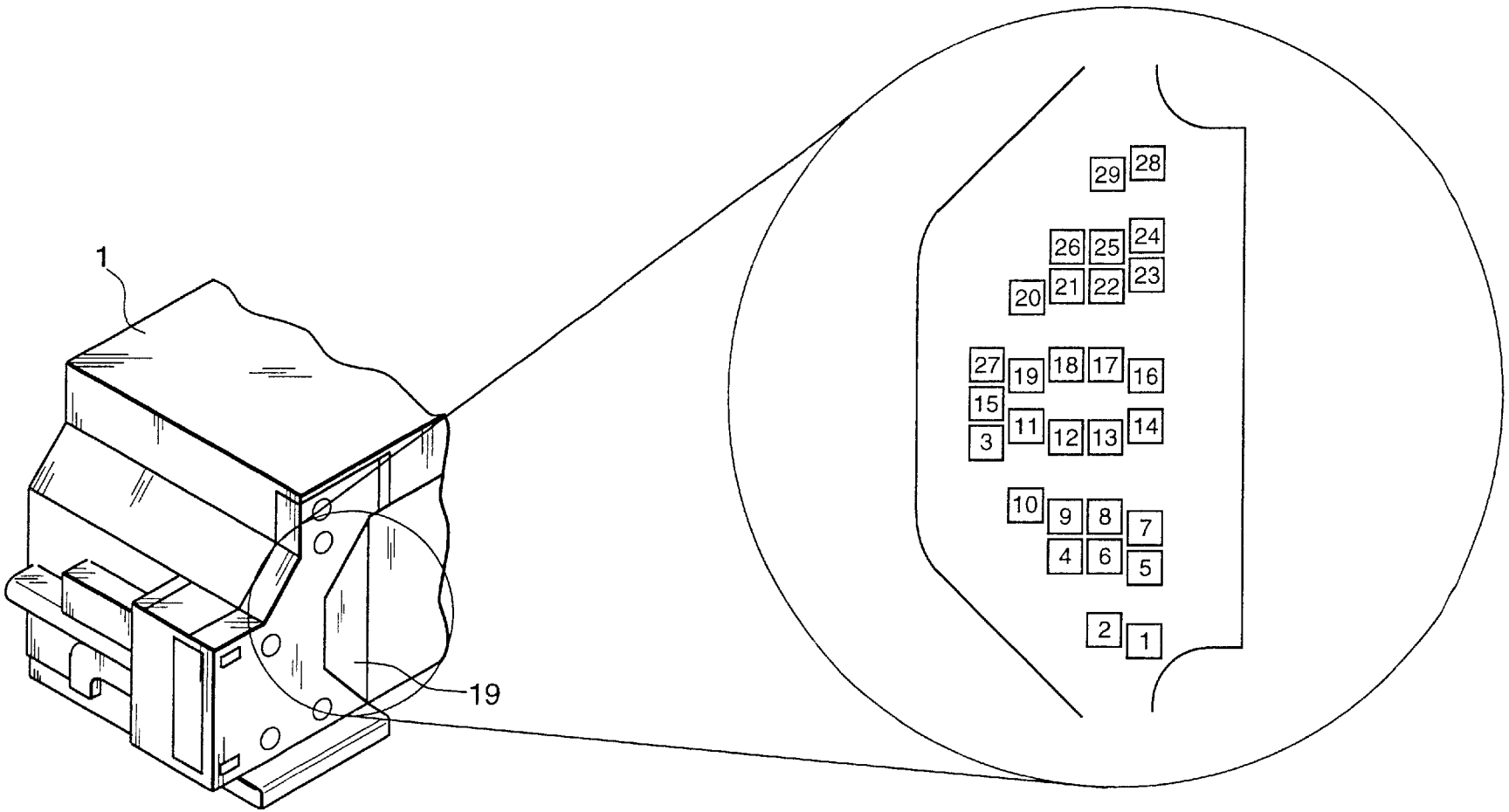
FIG. 4 is a diagram illustrating the electrical connection between the head cartridge and the printing apparatus according to this embodiment.

FIG. 4 is a detailed view showing the contact portion 19 of the head cartridge 1.

The contact portion 19 is provided with a plurality of electrode pads through which such signals as a signal relating to ink jetting and an ID signal for identifying the head cartridge 1 are exchanged with the ink-jet printing apparatus per se. By checking the state of conduction via the contact portion 19 shown in FIG. 4, it is possible to sense whether the head cartridge 1 has been replaced.

Figure 5:
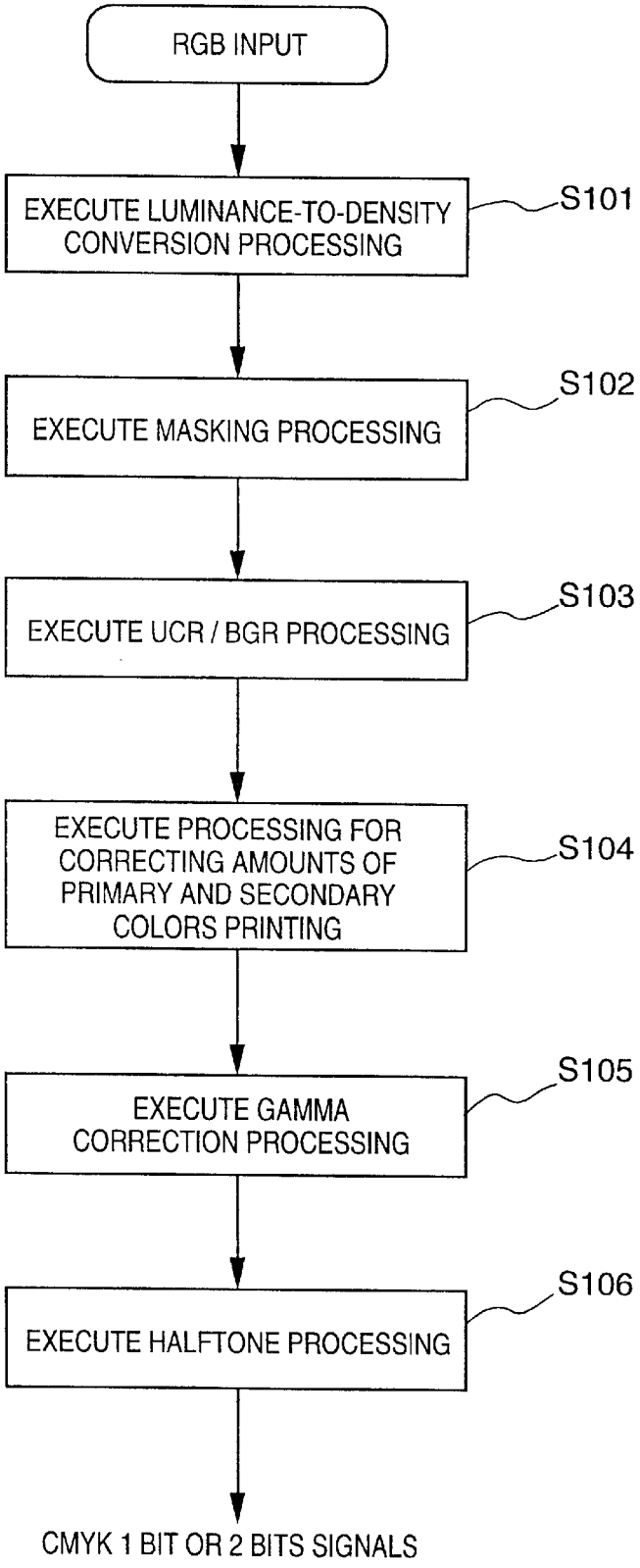
FIG. 5 is a flowchart illustrating the processing of print data in a printer driver according to this embodiment.

FIG. 5 is a flowchart illustrating an example of image processing by an image processing module in the printer driver 103 of this embodiment.

An RGB luminance signal is applied as an input signal in which one pixel consists of a total of 24 bits, where the pixel has R, G, B components each represented by eight bits. Luminance-to-density conversion processing is executed at step S101 to convert this input signal to a 24-bit density signal having C, M, Y signal components of eight bits each or a 32-bit density signal having C, M, Y, K signal components of eight bits each. Masking processing is executed at step S102 to apply a correction for unnecessary color components in the pigments contained in the CMY colorants. This is followed by step S103, at which UCR/BGR processing is applied to remove undercolors and extract the black component. Amounts of primary and secondary colors printed in regard to each pixel are limited at step S104. Here the primary color is limited to 300% and the secondary color to 400%.

This is followed by step S105, at which an output gamma correction is applied to linearize the output characteristic. Control then proceeds to step S106, at which 8-bit signals are subjected to halftone processing to convert the data of each of the colors C, M, Y, K to 1-bit or 2-bit signals. This halftone processing is executed using a method such as error diffusion or dithering.

Figure 6:
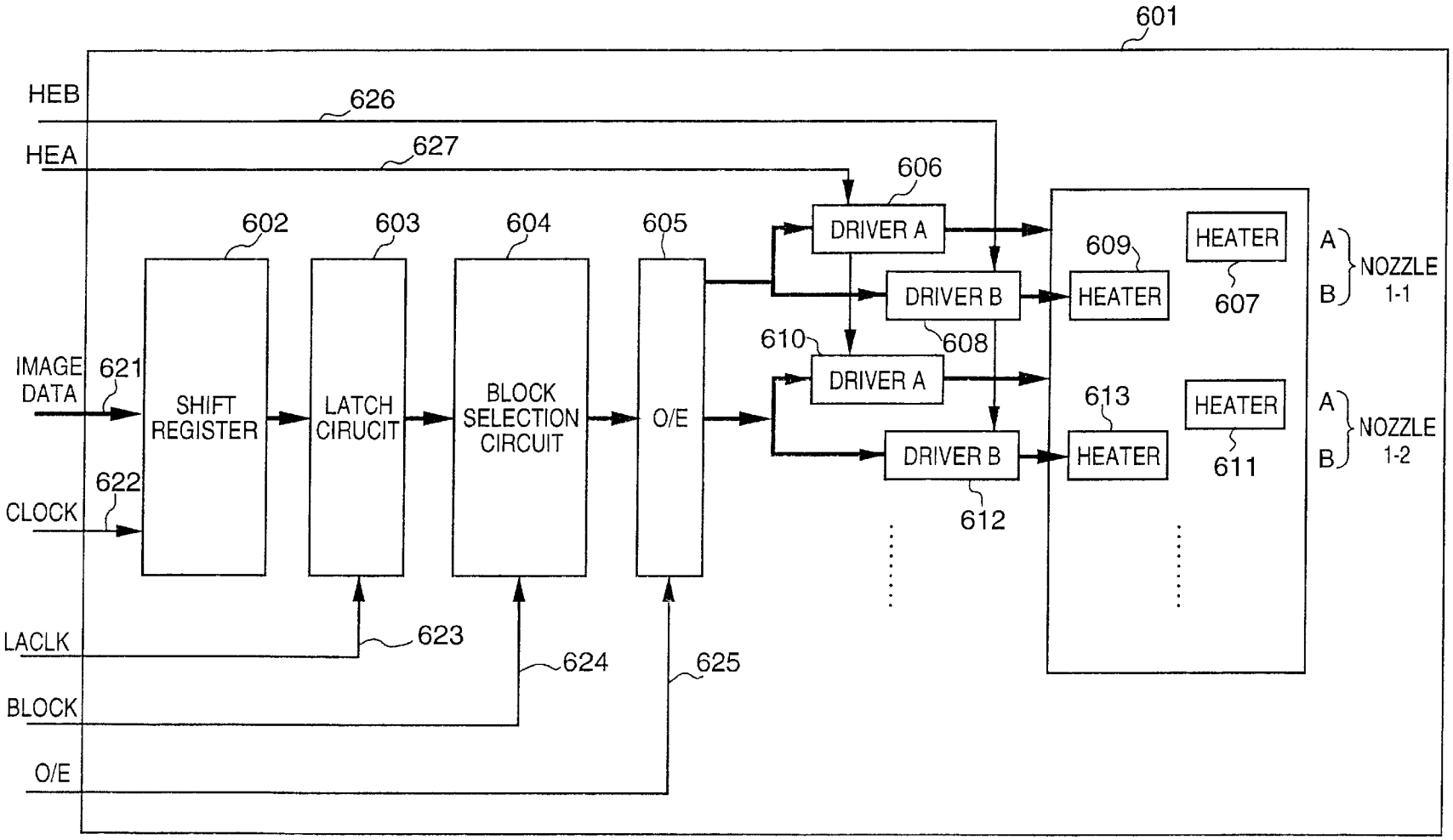
FIG. 6 is a block diagram showing the construction of a circuit board in the head cartridge according to this embodiment.

FIG.6 is a diagram showing the flow of signals within the head cartridge 1 of the ink-jet printing apparatus according to this embodiment. Of particular note here is that two heaters (heaters A, B) for ink jetting purposes are provided for each single nozzle and the heaters produce approximately identical amounts of heat. A case will be described wherein printing is carried out while changing the size of jetted ink drops by changing over the number of heaters driven. In another possible embodiment, a plurality of heating resistors (heaters) which produce different amounts of heat may be provided for each nozzle and the amount of heat produced may be controlled by driving the heaters selectively, thereby changing the amounts of ink jetted from the individual nozzles. Further, the method of jetting ink is not limited to the thermal method of this embodiment. For example, a technique relying upon piezoelectric elements may be used.

FIG. 6 shows a heater board 601 of the print head (the head cartridge 106). Image data 621 to be printed is sent to the heater board 106 serially in synchronization with a clock signal 622 from a controller (FIG. 15: CPU) of the printing apparatus. The image data 621 is transferred to and held by a shift register 602. When all image data that is to be printed at a single print timing has been sent to and stored in the shift register 602, the controller outputs a latch signal (LACLK) 623 and the data that has been stored in the shift register 602 is latched in a latch circuit 603 in sync with the latch signal (LACLK) 623. Next, the image data that has been stored in the latch circuit 603 is subjected to specified grouping through a variety of methods so that discrete dots will be printed by using the image data. The output of the latch circuit 603 is selected and output to each heater driver in accordance with a block selection signal (BLOCK) 624. An odd/even selector 605 selects and drives the odd-numbered or even-numbered nozzles of the print head, depending upon a selection signal (O/E) 625. In a case where the example of the circuit arrangement for the print head used in this embodiment is such that two ink jetting heaters A, B are provided for one nozzle and the amount of ink jetted from each nozzle is changed over, modulation is carried out by changing over the number of heaters used.

It is preferred that the shift register 602 and latch circuit 603 each be capable of holding a number of bits that is twice the number of nozzles (when one pixel is composed of two bits).

Various methods of controlling the size of printed dots can be conceived of in view of the arrangement described above. Here, by way of example, the arrangement adopted is such that if only an ink jetting heater 607 is driven by a heating enable signal (HEA) 627 via a driver A 606 where a first nozzle 1-1 is taken into consideration, a small dot will be formed of ink jetted from the nozzle 101. If ink jetting heaters A 607 and B 609 are driven approximately simultaneously by the heating enable signal (HEA) 627 and a heating enable signal (HEB) 628 via drivers A 606 and B 608, a large amount of ink will be jetted from the nozzle 1-1 to form a large dot. Similarly, in regard to a second nozzle 1-2, a small dot is formed when only an ink jetting heater A 611 is driven by a driver A 610, and a large dot is formed when ink jetting heaters A 611 and B 613 are driven approximately simultaneously by the driver A 610 and a driver B 612.

Figure 7:
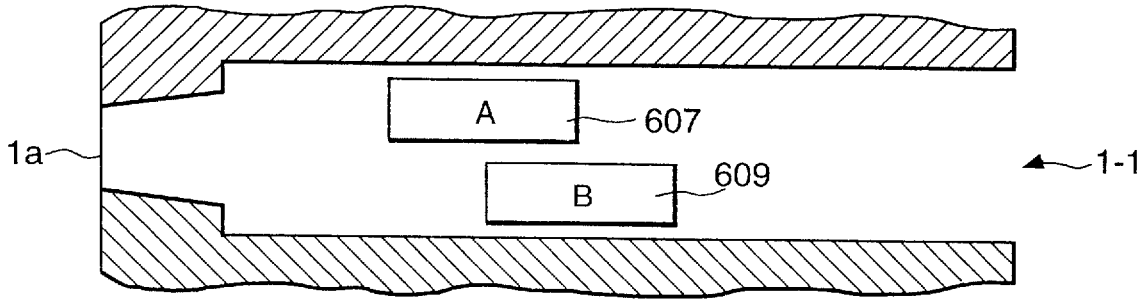
FIG. 7 is a sectional view showing an example of the construction of a nozzle in a print head according to a first embodiment of the invention.

FIG. 7 is a diagram showing the arrangement of the nozzle 1-1 of the ink-jet head according to a first embodiment of the invention. Here the two heaters A 607, B 609 for producing approximately the same amount of heat are provided inside the nozzle 1-1. The heater A 607 is placed at a position near a nozzle orifice 1*a*, and the heater B 609 is placed at a position remote from the orifice 1*a*. It should be noted that the ink-jet head having this nozzle may be used in a second embodiment as well.

Figure 8:
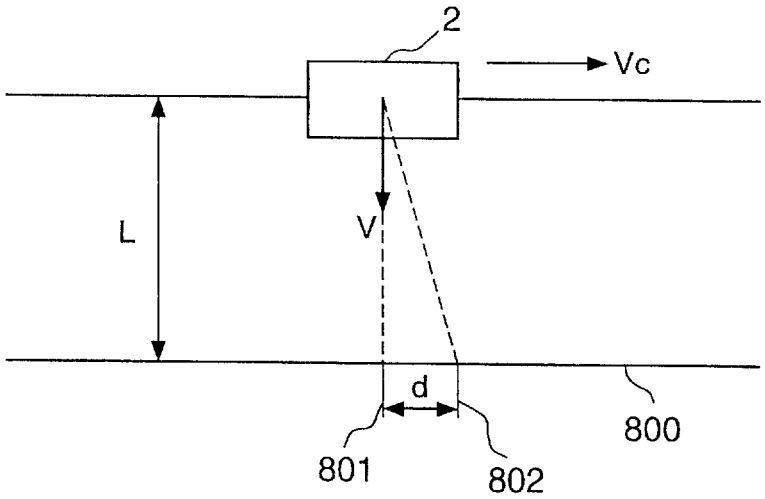
FIG. 8 is a diagram useful in describing a deviation in ink jetting position.

FIG. 8 is a diagram useful in describing the manner in which the carriage 2 is moved horizontally with respect to a recording medium 800 and ink is jetted onto the medium. Let Vc represent the traveling velocity of the carriage 2, L the spacing between the recording medium 800 and the nozzle tip of the head, V the velocity at which ink is jetted from the head and d a distance which represents an ink-drop deviation from a point 801, at which the ink drop is jetted from the head, to a point 802, at which the ink drop reaches the recording medium 800 after being jetted from the head.

Further, if f (Hz) represents the maximum driving frequency for printing dots of the same size from the same nozzle of the print head and N (dpi) represents the resolution at which printing is performed, the carriage velocity Vc for moving this print head will be expressed by the following equation:

$$Vc\ (mm/s)=\{25.4\ (mm)/N\}\times f$$

Now let V1 (mm/s) represent the velocity of a large ink drop (for forming a large dot) jetted from the nozzle and V2 the velocity of a small ink drop (for forming a small dot) jetted from the nozzle (where V1>V2) holds. The amount of positional deviation d1 in the scanning direction of the print head from the moment the large ink drop is jetted from the nozzle to the moment the large ink drop arrives at the recording medium during traveling of the print head is expressed by the following equation:

$$d1\ (mm)=Vc\times L/V1$$

Similarly, the amount of positional deviation d2 in the scanning direction of the print head in the case of a small ink drop is expressed by the following equation:

$$d2\ (mm)=Vc\times L/V2$$

Accordingly, the amount of positional deviation in a case where a large drop and a small drop are jetted simultaneously is d2−d1, which may be written $$d2-d1=Vc\text{-}L(1/V2-1/V1)$$
$$=(25.4/N)\cdot f\cdot L(1/V2-1/V1)\ (mm)$$

The unit length of one pixel is 25.4/N. If the positional offset (d2−d1) is expressed in terms of pixel length, therefore, we have $$(d2-d1)/(25.4/N)=f\cdot L(1/V2-1/V1)\ (pixels)$$
$$=f\cdot L(V1-V2)/V1-V2 \qquad \text{Eq. (1)}$$

It has been verified that if the amount of positional deviation between the centers of the two dots (the large dot and the small dot) is less than 0.5 pixel, the effect upon the quality of the printed image will be nil even if the dots of these two sizes are printed alternately. If this relationship is applied to Equation (1) above, it will be understood that a decline in the quality of a printed image can be prevented provided that the following condition is satisfied:

$$-0.5\ (pixel)=f\cdot L\ (V1-V2)/V1\cdot V2-0.5=0.5$$

Or, more specifically, providing that the following condition is satisfied:

$$0=f\cdot L(V1-V2)/V1-V2=1.0$$

Figure 9A:
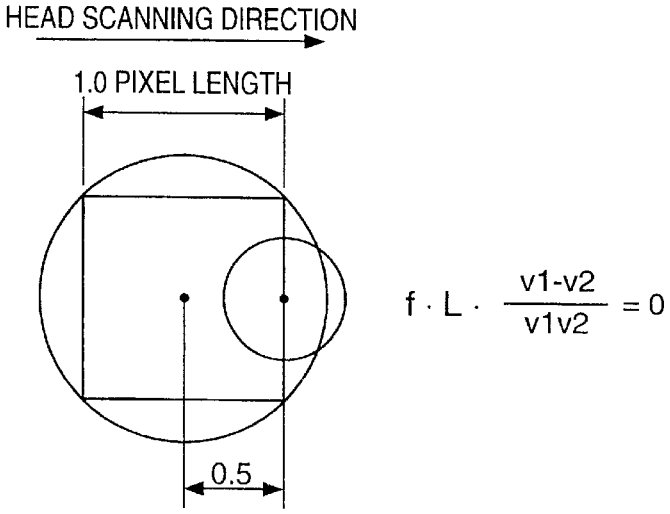
FIGS. 9A, 9B and 9C are diagrams useful in describing a difficulty brought about by forming a large dot first and then a small dot when forming a pixel by a plurality of dots.
Figure 9B:
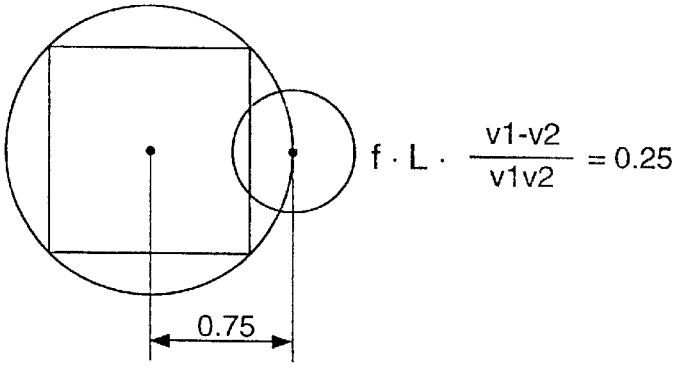
Figure 9C:
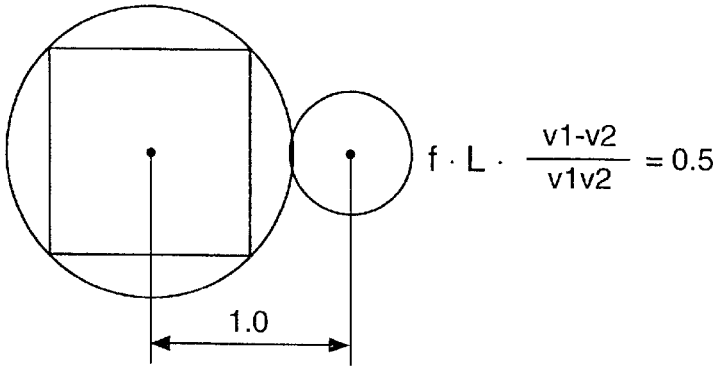

FIGS. 9A, 9B and 9C are diagrams useful in describing the positional relationship between large and small dots in a case where the large and small dots for one pixel are jetted from one nozzle at equal time intervals (each corresponding to 0.5 pixel) to form first the large dot of the pixel and then the small dot of the pixel when the print head is scanned from left to right in these drawings.

FIG. 9A shows the positional relationship between the dots when the small dot is formed after the larger dot under conditions in which the velocities of the large and small ink drops are the same (normally not possible) or in which the distance L between the nozzle tip and the recording paper is zero (normally not possible). In this case the large and small dots are formed in such a manner that their centers are spaced apart by 0.5 pixel. FIG. 9B shows a case where a positional deviation of 0.25 pixel has been caused by a difference in the velocities of the large and small drops (the large drop has the higher velocity) and the distance L between the nozzle tip and the recording paper. Here the large dot and the subsequently formed small dot have a spacing of 0.75 pixel between their centers. FIG. 9C shows a case where a positional deviation of 0.5 pixel has been caused by a difference in the velocities of the large and small drops and the distance L between the nozzle tip and the recording medium. Here the large dot and the subsequently formed small dot have a spacing of approximately one pixel between their centers.

By contrast, FIGS. 10A, 10B, 10C, 10D and 10E illustrate examples in which the problem of dot offset caused by a difference in the velocities of the large and small drops and the distance L between the nozzle tip and the recording medium is solved by forming the small dot for a pixel by jetting first the small ink drop from a given single nozzle and then forming the large dot for the pixel by jetting the large ink drop from the same nozzle.

Figure 10A:
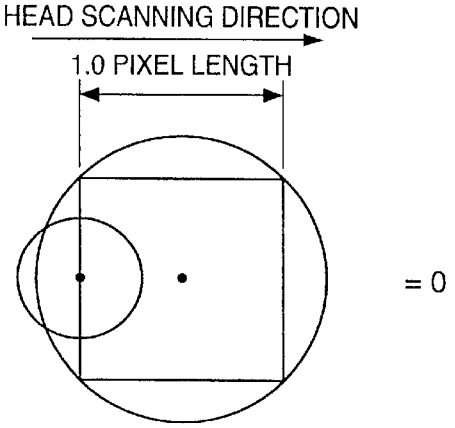
FIGS. 10A, 10B, 10C, 10D and 10E are diagrams useful in describing a deviation in dot position in a case where first a small dot is formed and then a large dot in this embodiment of the invention.
Figure 10B:
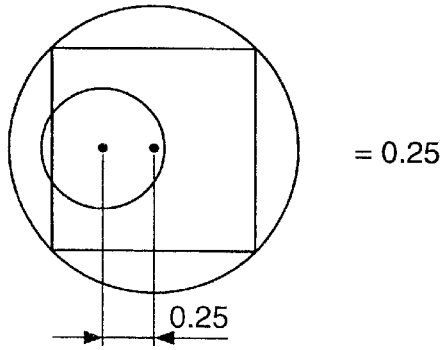
Figure 10C:
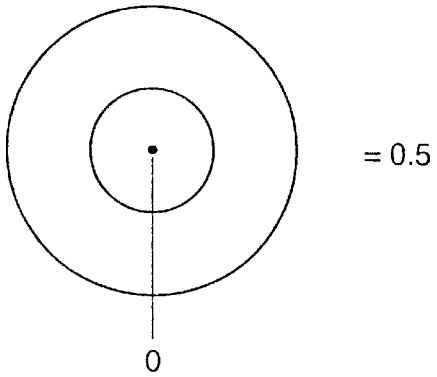
Figure 10D:
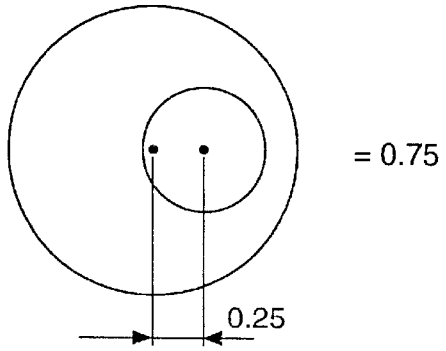
Figure 10E:
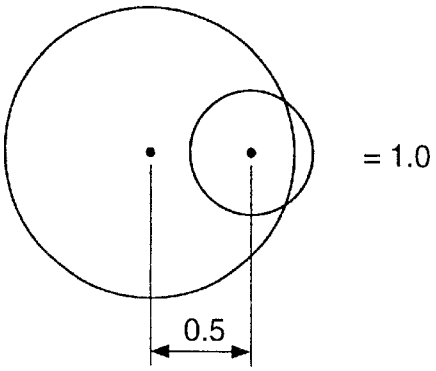

FIG. 10A illustrates the positional relationship of the dots in a case where the small dot is formed after the large dot under conditions in which the velocities of the large and small ink drops are the same (normally not possible) or in which the distance L between the nozzle tip and the recording paper is zero (normally not possible). In this case the large and small dots are formed in such a manner that their centers are spaced apart by 0.5 pixel. FIG. 10B shows a case where a positional deviation of 0.25 pixel has been caused by a difference in the velocities of the large and small drops (the large drop has the higher velocity) and the distance L between the nozzle tip and the recording paper. Here the small dot and the subsequently formed large dot have a spacing of 0.25 pixel between their centers and the small dot falls within the large dot. FIG. 10C shows a case where a positional deviation of 0.5 pixel has been caused by a difference in the velocities of the large and small drops and the distance L between the nozzle tip and the recording medium. Here the small dot and the subsequently formed large dot are formed with their centers in approximate coincidence. FIG. 10D shows a case where a positional deviation of 0.75 pixel is produced. Here the small dot and the subsequently formed large dot have a spacing of 0.25 pixel between their centers. FIG. 10E shows a case where a positional deviation of 1.0 pixel is produced. Here the small dot and the subsequently formed large dot have a spacing of 0.5 pixel between their centers.

Thus, if a large ink drop corresponding to one pixel is jetted first and then a small ink drop corresponding to the same pixel is jetted next, i.e., if the ink drop (large ink drop) having the higher velocity is first, as shown in FIGS. 9A through 9C in a case where one pixel is formed using a large dot and a small dot, the spacing between the large and small dots formed lengthens and each dot can be recognized as an individual dot. This produces a grainy appearance that lowers the quality of the image formed or causes the image to present a striped pattern or unwanted texture.

By contrast, according to this embodiment, when one pixel is formed, first the small ink drop corresponding to the pixel is jetted and then the large ink drop, as shown in FIGS. 10A through 10E. In other words, the small ink drop having the low velocity is jetted first to form the small dot first, then the ink drop having the high velocity is jetted to form the large dot next. When this is done, the large and small drops are formed in approximate superposition or are closely formed. As a result, a high-quality image free of graininess can be formed while the tone of the pixel is reproduced.

FIGS. 11A, 11B, 11C and 11D are diagrams illustrating an example in a case where printing is performed while moving the print head from left to right in the drawings. These diagrams are useful in describing a deviation in the formed dots based upon the difference in velocity between the small ink drop (for the small dot) and the large ink drop (for the large dot).

Figure 11A:
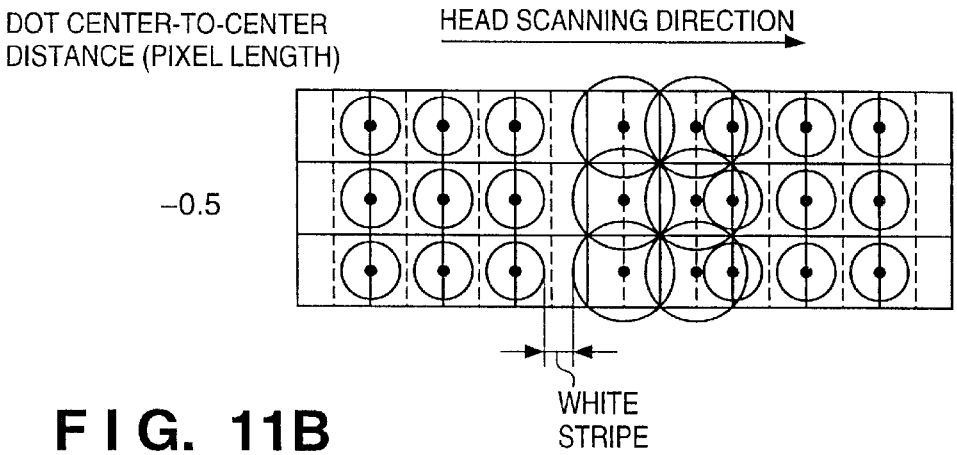
FIGS. 11A, 11B, 11C and 11D are diagrams useful in describing deviation in dot position caused by a difference in velocity between an ink drop for forming a large dot and an ink drop for forming a small dot.

FIG. 11A is a diagram illustrating an example in which a ruled line formed longitudinally at a width of two large dots is drawn in a uniform halftone pattern of small dots. Frames indicated by squares of solid lines in FIGS. 11A–11D indicate the rightful dot formation positions for which large dots are the reference. FIG. 11A shows a case where first a small ink drop is ejected and then a large ink drop. Here the small ink drop precedes the rightful formation position by 0.5 pixel (the large dots are formed at the rightful positions) so as to form a small dot. In this case the velocities of the ink drops for forming the large and small dots are the same (normally not possible) or the above-mentioned distance L is zero (normally not possible). A white stripe is produced between the large and small dots. At the moment the changeover from a large dot to a small dot is made, partial overlap between the large and small dots occurs.

Figure 11B:
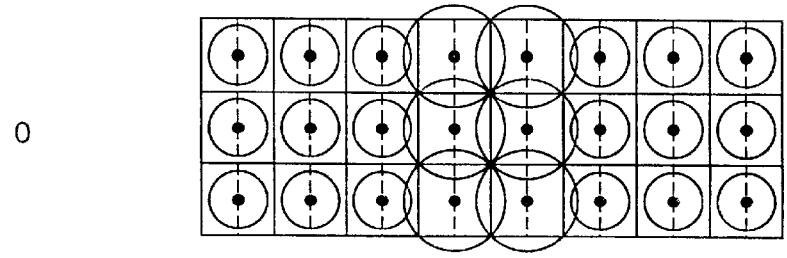
Figure 11C:
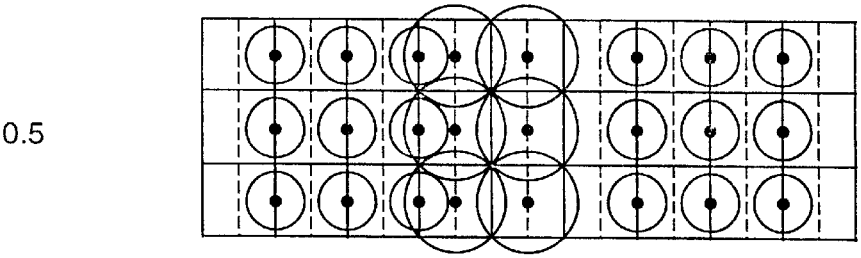
Figure 11D:
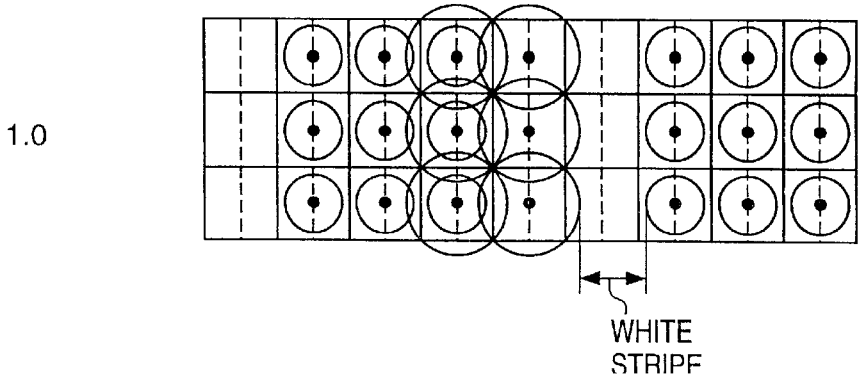

FIG. 11B illustrates a state in which the dots have been formed at their ideal conditions because the velocity of a small ink drop in FIG. 11A is less than that of a large ink drop. FIG. 11C shows a case in which a large dot is formed first and then a small dot. Here the velocities of the ink drops for forming the large and small dots are the same (normally not possible) or the above-mentioned distance L is zero (normally not possible). In this case the small dot precedes by 0.5 pixel. FIG. 11D illustrates a case in which the position at which the small dot is formed is delayed by 1.0 pixel from the rightful position of formation because the velocity of a small ink drop in FIG. 11C is less than that of a large ink drop. Two pixels are formed in superposition at the moment a changeover from a small dot to a large dot is made. Conversely, a white stripe having a width of one pixel is produced at the moment a changeover from a large dot to a small dot is made. It should be noted that if the center-to-center distance of the large and small dots thus formed is less than 0.5 pixel, the white stripe will not be very noticeable and there is essentially no problem in terms of image quality.

Printing according to this embodiment will be described with reference to FIGS. 7 and 12.

In a case where use is made of the head cartridge 106 having an ink tank containing ink of the usual density, only the heater A 607 near the orifice la shown in FIG. 7 is driven by a double pulse (FIG. 12) to jet approximately 21 pl ($10^{-12}$ liters) of ink from the orifice 1*a*. A small dot is formed in this case.

A large dot can be formed by driving both heaters A 607 and B 609 by double pulses (FIG. 12) to jet approximately 40 pl of ink from the orifice 1*a*. In this case let V1 (=14.5 m/s) represent the velocity at which a large ink drop is jetted to form a large dot and let V2 (=8.5 m/s) represent the velocity at which a small ink drop is jetted to form a small dot. If the spacing L between the recording medium and nozzle tip is equal to 1.5 mm and the frequency f at which the head is driven is equal to 6.5 kHz, then we have the following from Equation (1):

$$f \cdot L \cdot (V1-V2)/V1-V2=0.47$$

and a tone pixel can be printed by obtaining overlap between the large and small dots that is near ideal, as shown in FIG. 10C.

On the other hand, consider a case where use is made of a head cartridge (photo cartridge) having an ink tank containing high-density ink. In order to improve the quality of the printed image, only the heater A 607 near the orifice la shown in FIG. 7 is driven by a single pulse (FIG. 12) to jet a small ink drop of approximately 17 pl from the orifice 1*a*, thereby forming a small dot. When a large dot is to be formed, the heater A 607 is driven by a single pulse (FIG. 12) and the heater B 609 by a double pulse (FIG. 12), thereby jetting a large ink drop of approximately 39 pl from the orifice 1*a*, thereby forming the large dot. As a result, graininess of small dots is eliminated and printing (by a plurality of passes) is performed by superposing large dots, thereby making it possible to improve contrast.

In the case where the photo cartridge is used, the jetted velocity of a large ink drop for forming a large dot is made V1 (=13 m/s), and the jetted velocity of a small ink drop for forming a small dot is made V2 (=7 m/s). If the spacing L between the recording medium and nozzle tip is equal to 1.5 mm and the frequency f at which the head is driven is equal to 6.5 kHz, then we have the following from Equation (1):

$$f \cdot L \cdot (V1-V2)/V1 \cdot V2=0.64$$

and a positional deviation approximately midway between that of FIGS. 10C and 10D occurs and no significant problem arises. However, by lowering the driving frequency to 5.2 kHz to improve image quality, $$f \cdot L \cdot (V1-V2)/V1 \cdot V2=0.51$$

is obtained and a tone pixel closer to the ideal (FIG. 10C) can be printed.

FIG. 12 is a diagram useful in describing the relationship among drive pulse waveforms for forming large and small dots when use is made of the above-described cartridge for ink of ordinary density and the above-mentioned photo cartridge, the ink jetting velocities V1, V2 and the frequency f, etc.

Described next will be a case where printing is performed by a plurality of nozzles using the print head of the head cartridge 106 having a plurality of nozzles.

Figure 13:
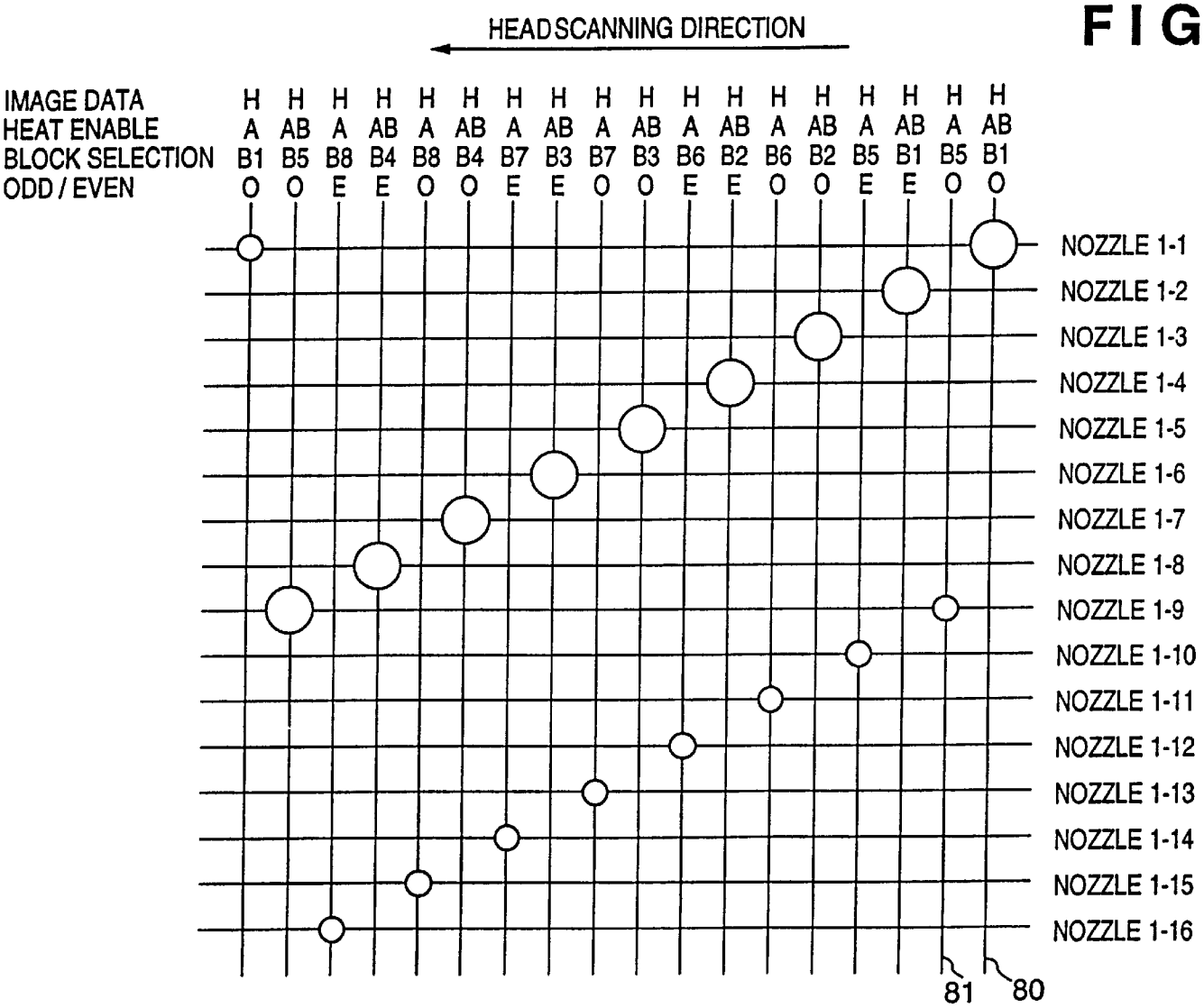
FIG. 13 is a diagram useful in describing timing for driving the nozzles of a print head in a printing apparatus according to an embodiment of the invention.

FIG. 13 is a timing diagram useful in describing ink jetting timing of a certain period using a print head having 16 nozzles.

The 16 nozzles of the print head are divided into eight blocks, as shown in FIG. 13, so that the nozzles may be driven in blocks. The first nozzle indicated by nozzle 1-1 and its neighboring nozzle (nozzle 1-2) constitute a block 1. As the nozzle numbers increase, so do the block numbers to 2, 3, 4, . . . in succession. In the example of FIG. 13, the nozzles have been divided into blocks 1 (B1) through 8 (B8). Only a nozzle for which four signals [image data (high level "H"), a heat enable signal (ON A or AB), a block selection (Bi) signal and an odd/even-number selection signal (O or E)] satisfy the conditions is driven to jet ink from the nozzle. This will be described with reference to the arrangement of FIG. 6.

Figure 16:
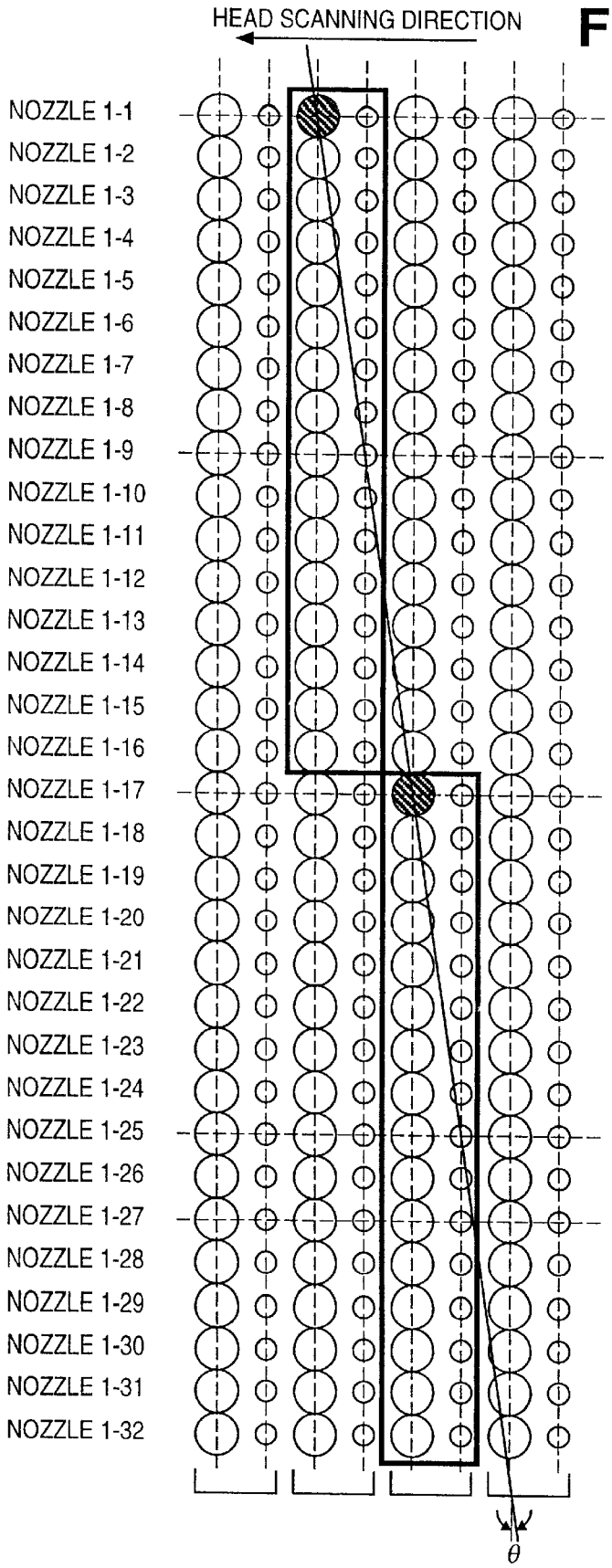
FIG. 16 is a diagram for describing nozzle drive timing when printing is performed by a print head according to this embodiment.

First, if the aforesaid four signals, namely image data (H), heat enable (A), block selection signal (block 1: B1) and odd/even-number selection signal (odd: O) overlap at timing 80 in regard to nozzle 1-1, drive signals are sent to the drivers A 606, B 608 connected to the ink jetting heaters A 607, B 609, respectively, of nozzle 1-1 because the heat enable signal is "AB". As a result, a large dot is formed by the nozzle 1-1. Next, if the aforesaid four signals, namely image data (H), heat enable (A), block election signal (B5) and odd/even-number selection signal (odd: O) overlap at timing 81 in regard to nozzle 1-9 of block (because the head is mounted obliquely as shown in FIG. 16), a drive signal is sent to the driver A connected to the ink jetting heater A of nozzle 1-9 because the heat enable signal is "A". As a result, a small dot is formed by the nozzle 1-9.

Next, if similar processing is executed in regard to nozzle 1-2 of block 1 and nozzle 1-10 of block 5 and driving of nozzles up to nozzle 1-8 of block 4 and nozzle 1-16 of block 8 is finished, then one cycle of printing of large dots with respect to nozzles 1-1 through 1-8 and one cycle of printing of small dots with respect to the nozzles 1-9 through 1-16 will be completed. Furthermore, when one cycle of printing of small dots with respect to nozzles 1-1 through 1-8 and one cycle of printing of small dots with respect to nozzles 1-9 through 1-16 are completed (only a part of such printing is illustrated), then this will complete a total of two cycles of printing comprising one cycle for large dots and one cycle for small dots with respect to all nozzles 1-1 through 1-16.

Figure 14:
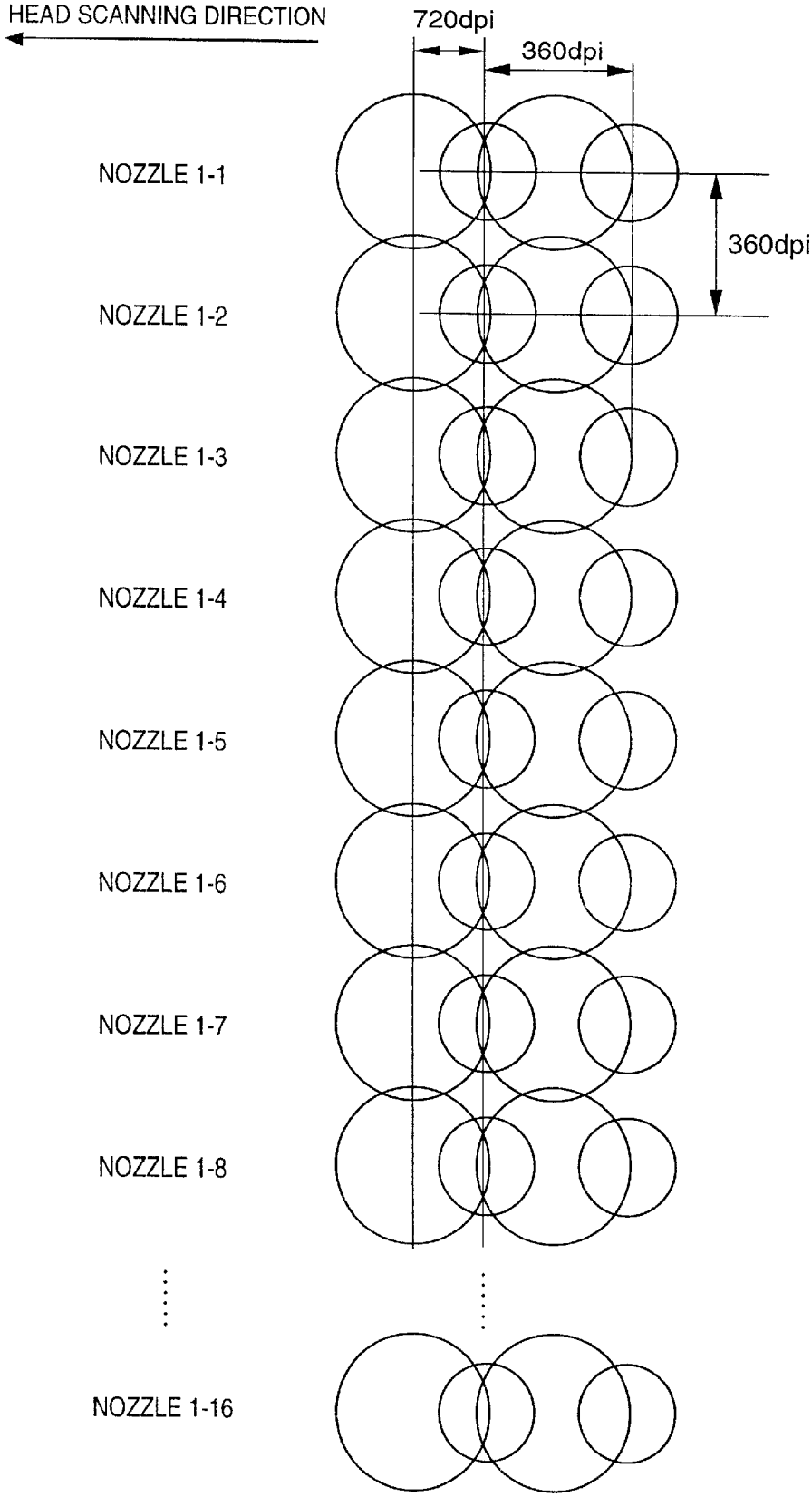
FIG. 14 is a diagram illustrating rows of dots printed at the timing of FIG. 13 in the printing apparatus of this embodiment of the invention.

The timing at which an image is thus formed is as illustrated in FIG. 14. This shows a dot arrangement on a recording medium in a case where printing has been performed upon making the ink jetting timing of each nozzle conform to an address corresponding to a resolution of 720 dpi×360 dpi. FIG. 14 illustrates a state in which 2-bit print data in regard to each nozzle of all nozzles is "11"(maximum density), a large dot is obtained from two cycles (32 dots) and a small dot is obtained from two cycles (32 dots). In other words, FIG. 14 shows a case in which two pixels have been formed by each nozzle.

Described next will be an example in which a printing apparatus capable of forming these large and small dots is used in an actual printing system.

Figure 15:
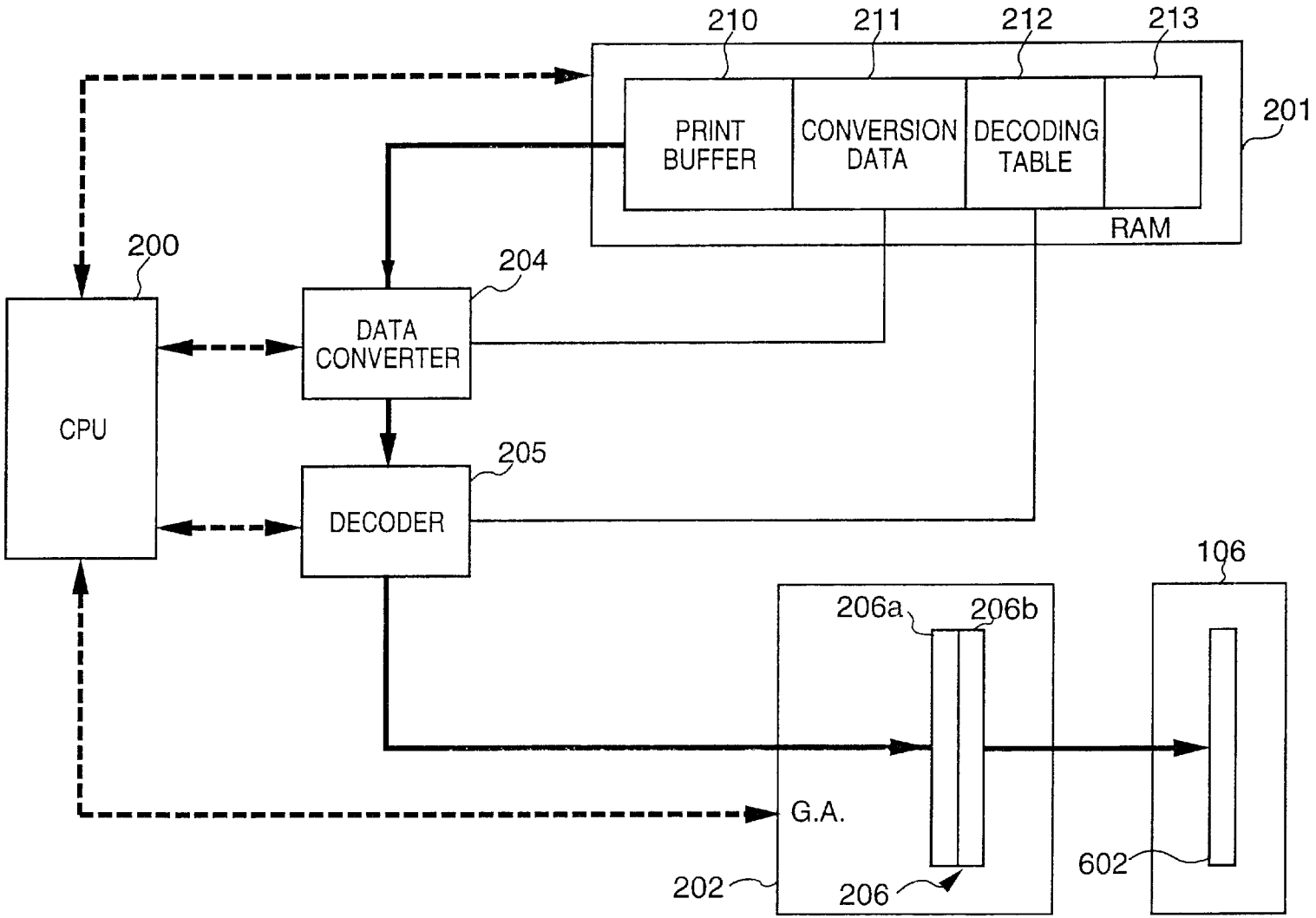
FIG. 15 is a block diagram illustrating the construction of a print data processing circuit within the printing apparatus of this embodiment.

FIG. 15 is a diagram illustrating the flow of data sent from the controller (CPU 200) of an ink-jet printing apparatus to the head 106. Components identical with those of the earlier drawings are designated by like reference characters and need not be described again.

The CPU 200 controls the overall operation of the printing apparatus according to this embodiment. It should be noted that FIG. 15 illustrates the flow of signals only through portions related to the gist of this embodiment. A RAM (random-access memory) 201 has a print buffer 210 for storing print data, a conversion data area 211 storing conversion data for converting pixel data, a decoding table 212 and a work area 213. Print data that has been stored in the print buffer 210 is data in which each pixel is composed of two bits. A gate array (G.A.) 202 reads print data, which has been stored in the print buffer 210, out of the buffer by direct memory access (DMA). Ordinarily data is read out of the print buffer 210 at a multiple of one word (16 bits). Consequently, in regard to data in which each pixel consists of two bits, data enclosed by the frame indicated by the bold line in the array of data shown in FIG. 16 is read out by the gate array 202. A data converter 204 in FIG. 15 converts pixel data in accordance with conversion data. When multiple-pass printing is performed, the data converter 204 divides the data for each printing pass. A decoder 205 decodes (modulates) 2-bit print data in accordance with table data (modulation data) that has been stored in the decoding table 212. The gate array 202 has a register 206, which includes a register 206*a* for storing data for forming a large dot and a register 206*b* for storing data for forming a small dot.

FIG. 16 is a diagram for describing the timing at which ink is jetted from each nozzle of the print head. The circles of large diameter indicate timings (large dots) at which large ink drops are jetted, and the circles of small diameter indicate timings (small dots) at which small ink drops are jetted. In the example of FIG. 16, only part of the print head (32 nozzles) having 256 nozzles is illustrated. This head is installed obliquely at a prescribed angle θ with respect to the scanning direction (the horizontal direction in FIG. 16) of the head.

In the first cycle, ink is jetted by driving two nozzles each simultaneously in the following manner: nozzles 1-1 and 1-17 for large dots, then nozzles 1-9 and 1-25 for small dots, then nozzles 1-2 and 1-18 for large dots, then nozzles 1-10 and 1-26 for small dots, . . . , nozzles 1-8 and 1-24 for large dots, and nozzles 1-16 and 1-32 for small dots. In the next cycle, neighboring 2-bit data to the left of the data enclosed by the bold frame is read out before the start of this cycle. Ink is then jetted from two nozzles each simultaneously in the following manner: nozzles 1-1 and 1-17 for small dots, then nozzles 1-9 and 1-25 for large dots, then nozzles 1-2 and 1-18 for small dots. By executing this processing in regard to all 32 nozzles, a total of 32 pixels are printed at maximum density (large and small dots). In the third cycle, in a manner similar to that of the first cycle, printing is performed by driving two nozzles each simultaneously in the following manner: nozzles 1-1 and 1-17 for large dots, then nozzles 1-9 and 1-25 for small dots, then nozzles 1-2 and 1-18 for large dots. In the example of FIG. 16, the 2-bit print data for each nozzle is "11" (maximum density).

Further, in regard to each pixel, ink is jetted so as to form a small dot first and then a large dot. It should be noted that this does not depend upon the diameter of the dot formed. What is of importance is that the ink having the lower ink jet velocity at formation of a dot of pixel is jetted first in order to form the pixel.

When the 2-bit print data is read out of the print buffer 210 and stored in the register 206 of the gate array 202 in order to express a tone by combining two dots from this print data according to this embodiment, the data is converted by the data converter 204 and decoder 205 and stored. Though several methods may be contemplated in case of one-pass printing and multiple-pass printing, an embodiment for one-pass printing will be described first.

FIG. 17 is a diagram illustrating an example wherein print data in which each pixel read out of the print buffer 210 is represented by two bits has been decoded using the decoder 205. The small circles in FIG. 17 indicate small dots and the large circles represent large dots.

In the printing apparatus according to this embodiment, 4-level data (namely data in which each pixel is represented by two bits) output by the printer driver 103 of the host computer is accepted and written to the print buffer 210. Next, in accordance with the content (shown in FIG. 17) that has been stored in the decoding table 212 in conformity with the 2-bit data of the print buffer 210, the print data is decoded by the 2-bit decoder 205 and is transferred to the register 206 of the gate array 202 by DMA while this decoding is being carried out. It should be noted that when one-pass printing is carried out, this print data passes through the data converter 204 unaffected. In the example illustrated in FIG. 17, the two higher order bits are allocated to a larger dot and the two lower order bit to a small dot. However, by changing the content of the decoding table 212, any decoded output can be obtained with respect to 2-bit data.

The situation for multiple-pass printing will be described next. In this case, as depicted in FIG. 18, the rows of nozzles of the print head are divided into n blocks (n=3 in the example of FIG. 18), the recording medium is fed in the sub-scan direction by the length of the nozzle row divided by n every time the print head makes one scan, and interpolated data is printed every scan to complete the image.

Figure 18:
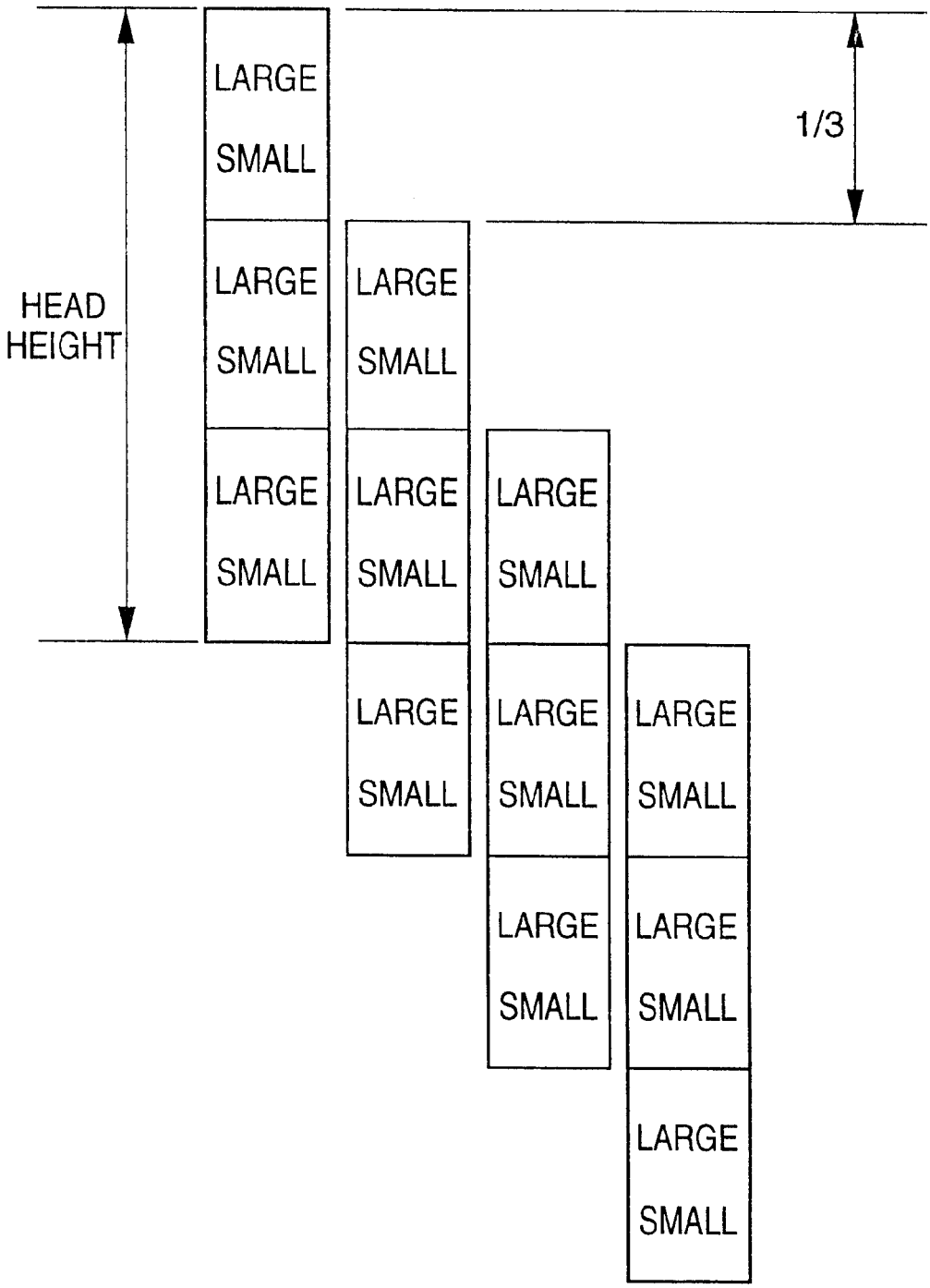
FIG. 18 is a diagram for describing a multiple-pass printing method.

In FIG. 18, a state is shown in which the recording medium is fed every scan by a length equivalent to one-third the length of the nozzle rows, with printing being performed in three passes (equivalent to one band). The conventional printing method is such that when the printing of a sub-sampled image is finished in each scan in the main-scan direction, the recording medium is fed in the sub-scan direction and printing in the main-scan direction is carried out again to print the image that was subsampled in the preceding main scan, thereby completing the printing of the image. In accordance with the present invention, 2-bit data is output, in a manner similar to that described above, in regard to printing in each scan, and a decoding function is provided in addition to the conventional subsampling function (data conversion in this example) to further broaden the range of tone expression.

This function will be described with reference to FIG. 19.

In order for print data to express a tone by two bits in this embodiment, data for subsampling (for data conversion) is created by a combination of two bits and the data is stored in the conversion data area 211 of the RAM 201. The results of decoding in each pass are indicated at 160, 161, 162 in FIG. 19, and the result of printing the 2-bit data by three passes is indicated at 163. It should be noted that FIG. 19 illustrates a mere example and it goes without saying that the invention is not limited to this example. By performing printing using such an arrangement of bits, the items of 2-bit data are distributed evenly in the manner of random numbers in each scan. This makes it possible to almost completely eliminate the difference in number of dots printed by each scan. That is, 160 in FIG. 19 indicates a decoded output (dot formation) of a first pass, 161 a decoded output (dot formation) of a second pass and 162 a decoded output (dot formation) of a third pass.

According to this embodiment, the distribution of large and small dots is taken into consideration in the two bits and sampled by using a decoding table of 2-bit codes. Consequently, it is possible to distribute the sizes of each of the dots evenly in each scan even in a case where the numbers of large and small dots are extremely one-sided. If this function is used effectively, printing which is a combination of three large dots and three small dots can be performed using a head capable of forming large and small dots, printing in multiple passes, decoding based upon 2-bit codes and random data conversion. This is in contrast to the prior art, in which the number of tones is three with a dynamic range up to a maximum of two dots at two bits. Further, according to this embodiment, it is possible to freely select four tones from 16 as a selectable combination. Furthermore, by increasing the number of passes of multiple-pass printing and increasing the 2-bit codes to 3-or 4-bit codes, tone expression capability can be improved markedly and dynamic range can be widened. An arrangement may be adopted in which a plurality of tone modulations are made possible, without the number of modulations being limited to the two tones of large and small dots.

Figure 20:
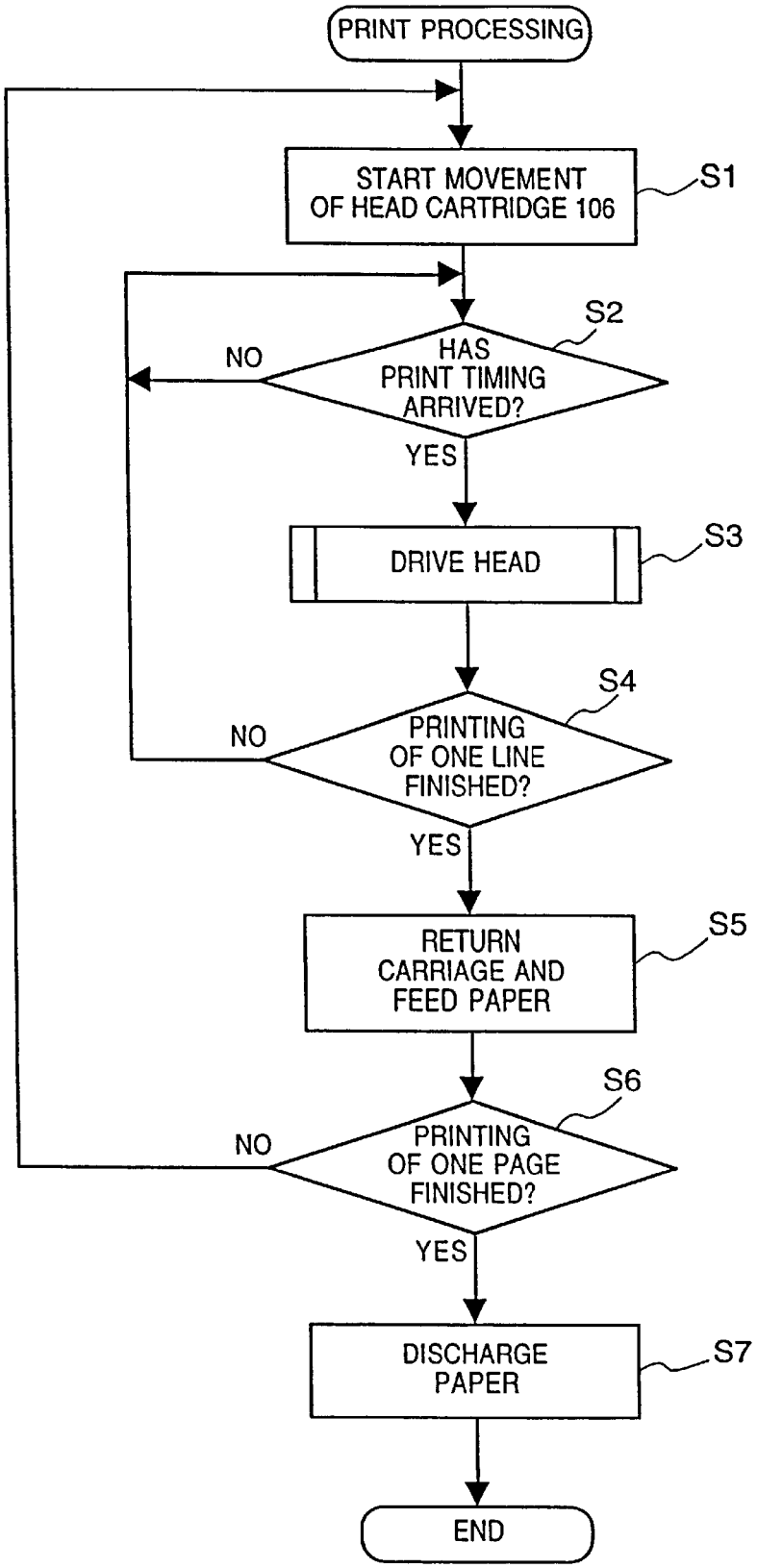
FIG. 20 is a flowchart illustrating printing processing in an ink-jet printing apparatus according to this embodiment.

FIG. 20 is a flowchart illustrating printing processing in an ink-jet printer according to this embodiment. This processing is executed under the control of the CPU 200. This processing is started by receiving data from the host computer and storing print data of at least one scan or one page in the print buffer 210.

Drive of the carriage motor 6 is started at step S1 to start movement of the head cartridge 106, and it is determined at step S2 whether timing for printing by the head has arrived. When printing timing arrives, control proceeds to step S3, at which the head is driven to perform printing (the flowchart of FIG. 21) by one row of nozzles of the head. This is followed by step S4, at which it is determined whether one line of printing processing has ended. Control returns to step S2 if one line of printing processing has not ended but proceeds to step S5 if one line of printing processing has ended. A carriage return is performed and the recording paper is transported at step S5 by a length equivalent to the printing width. This is followed by step S6, at which it is determined whether the printing of one page has ended. Control returns to step S1 if one page of printing processing has not ended but proceeds to step S7 if one page of printing processing has ended. The paper on which printing has thus been completed is ejected from the printer at step S7.

Processing (step S3 in FIG. 20) for driving the head in the ink-jet printer according to this embodiment will be described with reference to the flowchart of FIG. 21.

Print data equivalent to one row of the nozzles of the print head is read out of the print buffer 210 at step S11. This data is passed through the data converter 204, decoded by the decoder 205 and set in the registers 206*a*, 206*b* of the gate array 202 (this is carried out by DMA) at step S12.

The data that has been set in the registers 206*a*, 206*b* is transferred to the shift register 602 of the head 106 at step S13. According to this embodiment, heater A or heater B is driven in accordance with the corresponding print data, whereby each nozzle forms a tone pixel (comprising a maximum of two bits) conforming to the tone of the print data. At step S14, therefore, it is determined whether the timing for driving the heaters A and B (namely the timing for forming a large dot) has arrived. If the decision rendered is "YES", then control proceeds to step S15, at which the block selection signal 624 and odd/even-number signal 625 are output to decide the nozzle positions at which the heaters A, B are driven substantially simultaneously. The signals 626, 627 for driving the heaters A, B are output. When this drive is performed, the heaters are driven by driving pulses conforming to the type of ink used, as illustrated in FIG. 12 described above. As a result, if data corresponding to a selected nozzle is "1", then a large dot is formed by this nozzle. When an ink tank containing ink of ordinary density has been installed in this case, the heaters A, B are both driven by double pulses. When an ink tank containing ink of high density has been installed, heater A is driven by a single pulse and heater B by a double pulse (see FIG. 12).

Next, control proceeds to step S16, at which it is determined whether the drive timing solely for heater A (the drive timing for printing a small dot) has arrived. If the answer is "YES", then control proceeds to step S17, at which the block selection signal 624 and odd/even-number signal 625 are output to decide the nozzle position at which the heater A is driven. The heating signal 627 is then output. As a result, if data corresponding to this nozzle is "1", then a small dot is formed by this nozzle. When an ink tank containing ink of ordinary density has been installed in this case, the heater A is driven by double pulses. When an ink tank containing ink of high density has been installed, the heater A is driven by a single pulse (see FIG. 12).

This is followed by step S18, at which it is determined whether all nozzles of the head have been driven to perform printing. If the decision rendered is "YES", control returns to the original processing. If the decision is "NO", control proceeds to step S14, at which it is determined whether the drive timing of heaters A and B of the next nozzle has arrived (or whether the drive timing solely of heater A of the next nozzle has arrived), and printing is performed in successive fashion.

Though not shown in the flowchart, the type of head cartridge (the type of ink) used in printing can be identified by the method described above with reference to FIG. 4, and the method of driving the heaters A and B and the driving frequency f are changed in dependence upon the type of ink, thereby making it possible to obtain an image of higher quality.

Figure 21:
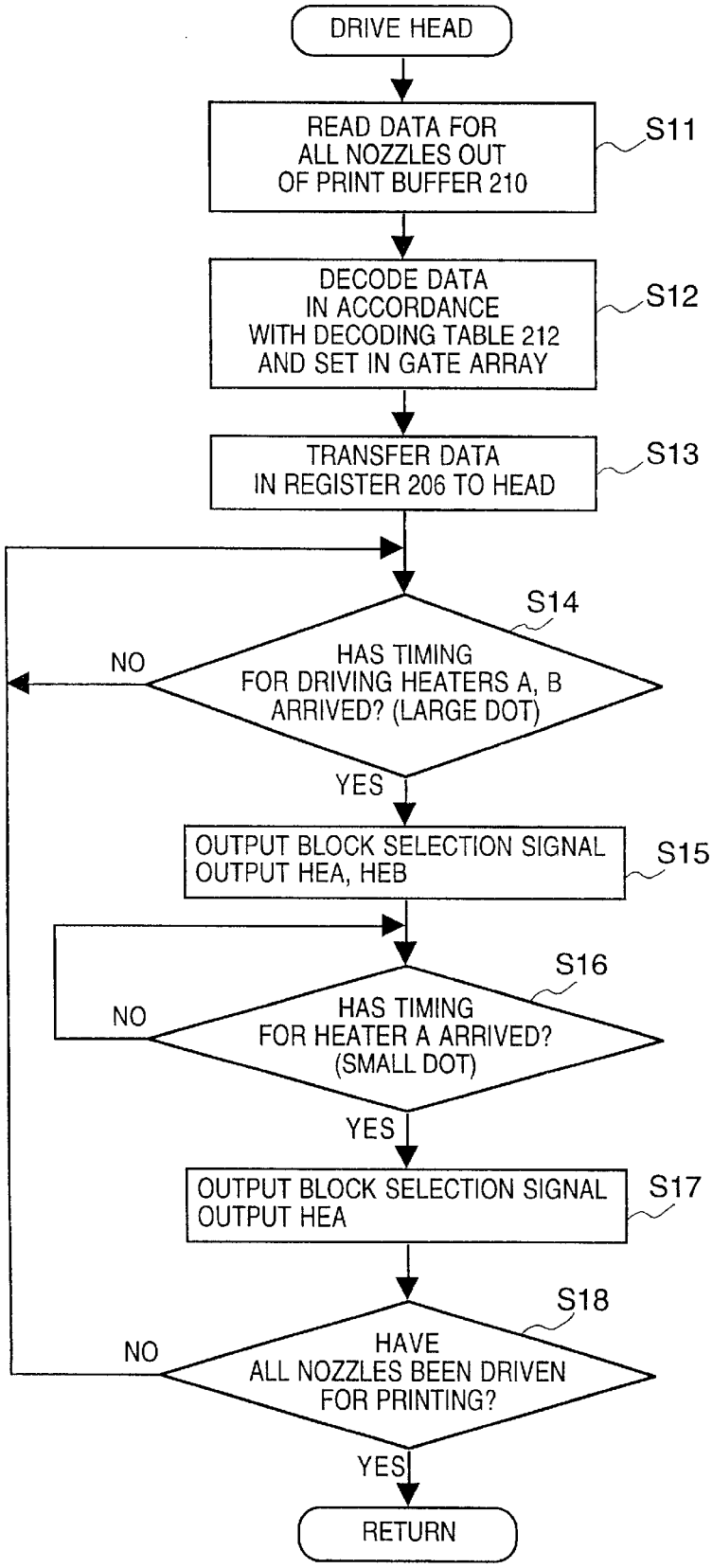
FIG. 21 is a flowchart illustrating head drive processing at step S3 in FIG. 20.
Figure 22:
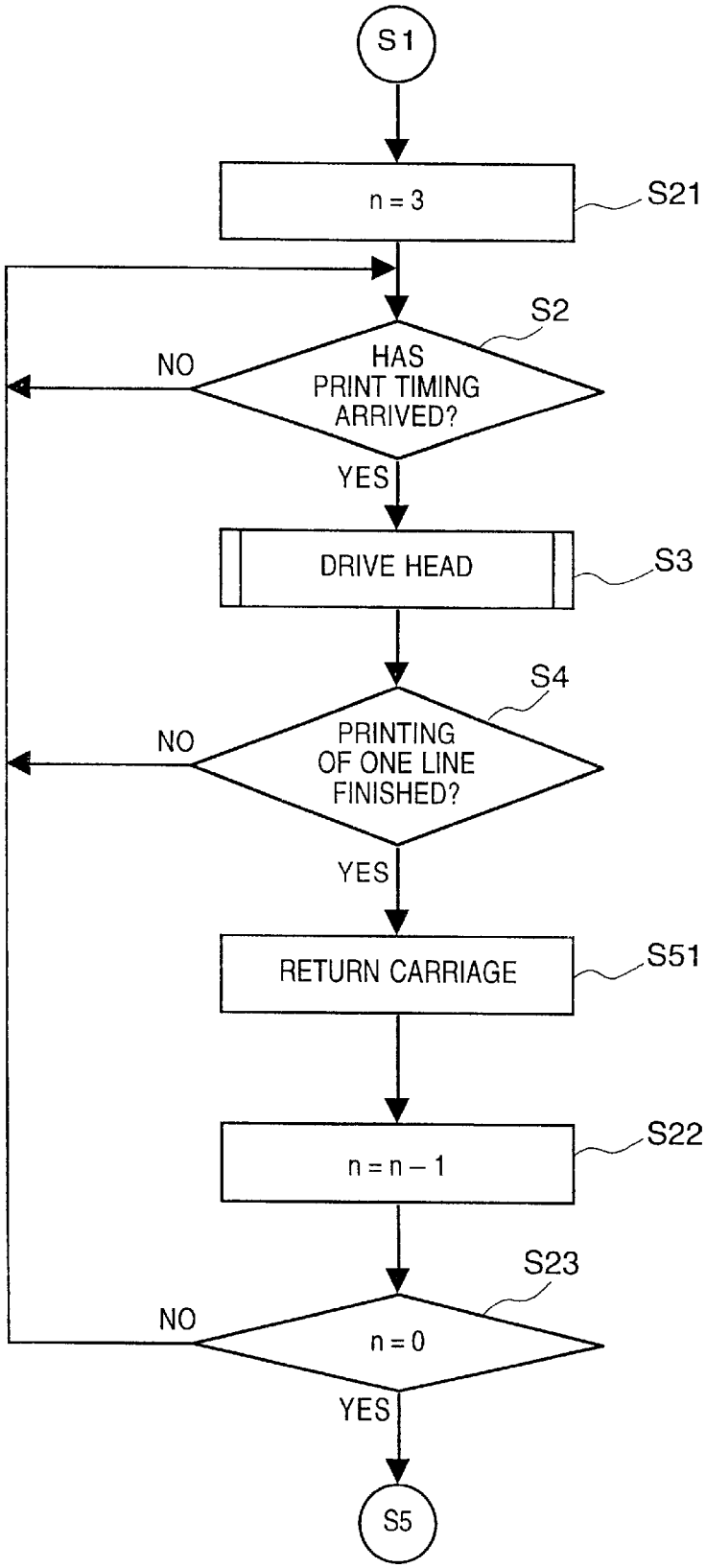
FIG. 22 is a flowchart for describing printing in three passes according to this embodiment.

FIG. 22 is a flowchart illustrating processing in a case where printing is performed by three passes in this embodiment. Steps identical with those of the flowchart shown in FIG. 21 are designated by like step numbers and need not be described again.

Step S21 calls for n to be set to 3. After one scan is completed, the operation n=n−1 is executed at step S22. By performing head drive of steps S2 through S5 until the relation n=0 is established at step S23, 3-pass printing can be realized with ease. Data printed in conformity with each scan of the head is created by the data converter 204 and decoder 205 of FIG. 15 at this time and, byway of example, is decoded as indicated by the numerals 160 through 162 in 10 FIG. 19.

In the flowchart of FIG. 21, the heaters A, B are driven substantially simultaneously when a large dot is formed.

Figure 23A:
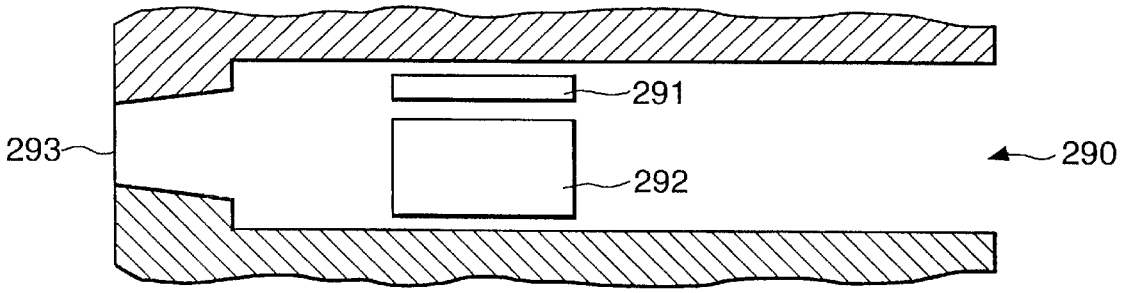
FIGS. 23A, 23B and 23C are sectional views showing examples of nozzle arrangements in a print head according to this embodiment.
Figure 23B:
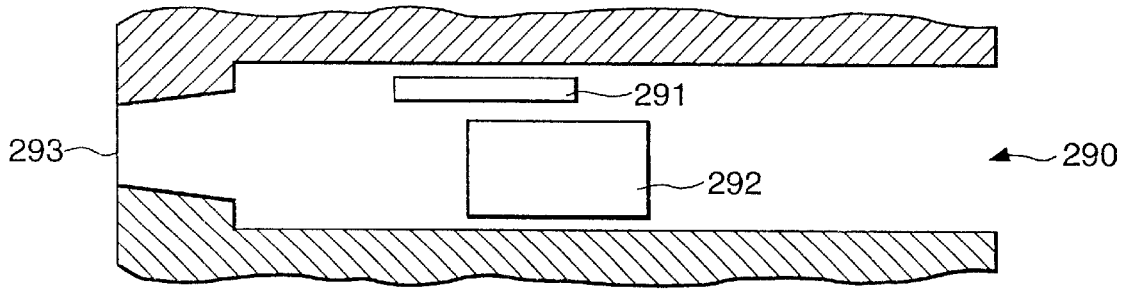
Figure 23C:
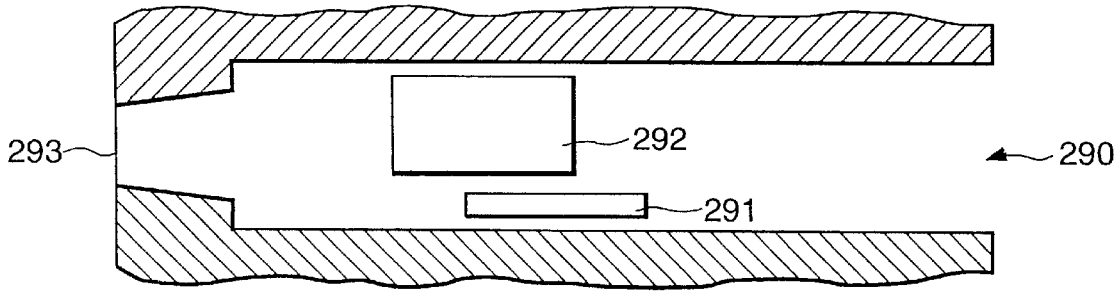

However, as indicated in FIGS. 23A through 23C described later, it is of course permissible to drive only the small 15 heater 291 when a small dot is formed and drive the large heater 292 , or both the large and small heater 291, 292 approximately simultaneously, when a large dot is formed.

Second Embodiment

FIGS. 23A, 23B and 23C illustrate examples in which the small heater 291 and large heater 292, which produce different amounts of heat, are provided inside one nozzle 290, with the positions of the heaters being different in each example. By driving only the small heater 291, only the large heater 292 or both the small heater 291 and large heater 292, an ink drop of an amount equivalent to that for forming any of three types of drops, namely a small dot, medium dot and large dot, can be jetted from an orifice 293. In a case where the head having the construction shown in FIGS. 23A through 23C is applied to the first embodiment described above, a relatively large dot and a relatively small dot can be formed by employing any drive method that drives only the small heater 291, only the large heater 292 or both the small heater 291 and large heater 292 substantially simultaneously.

The conditions for recording a dot at a specified position on a recording medium in the above-described arrangement are as follows:

(1) A bit corresponding to print data, which corresponds to each nozzle, that has been latched in the latch circuit 603 is "1" (indicating that data is present).

(2) This corresponds to the block that has been selected by the block selection signal 624.

(3) The selection signal 625 for selecting an odd- or even-numbered nozzle and the nozzle position correspond.

(4) Either the corresponding bit enable signal 626 or 627 (or both) is input.

When the four conditions are satisfied simultaneously, either the heater A or the heater B (or both) of the corresponding nozzle is actuated so that a large dot or small dot is formed by this nozzle. That is, the size of the ink drop jetted from the nozzle is decided depending upon whether the heat enable signal entered at this time is the HEA signal 627 or the HEB signal 626, and the position at which a large dot or small dot is formed is decided depending upon the particular block timing at which the print data is raised to the high level (i.e., "1").

Before an example of a case in which printing is performed using such an ink-jet head is described, we will describe a shift in position at which ink arrives at the recording medium when the above-mentioned large and small ink drops are formed.

It is clear that the position at which a dot is formed on a recording medium after ink is jetted from a nozzle when forming a small dot differs, though only slightly, from that when a large dot is formed. Accordingly, it is conceivable that a problem will occur wherein when a large dot and a small dot are each formed during one scan of the print head, the positions at which the large and small dots are formed will deviate from each other slightly, thereby causing the printed image to develop texture.

Figure 24A:
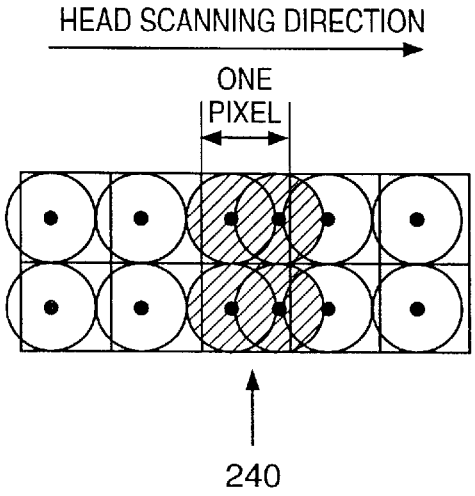
FIGS. 24A and 24B are diagrams for describing the printing of an image by two ink drops of the same amount of ink according to a second embodiment of the invention.
Figure 24B:
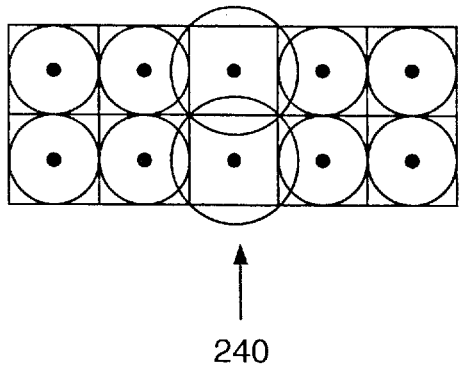

FIGS. 24A and 24B illustrate examples of dot formation. The frames indicated by the grids show ideal positions at which pixels are formed. Consider a case where two small dots are printed in superposition within a frame indicated at 240. In a case where the velocities of ink drops for forming small dots output from one nozzle are the same, the timings at which the ink drops for forming the small dots are jetted from the head will not agree if it is attempted to form the two small dots at the same position of the frame 240 during scanning. Consequently, the dot positions are slightly offset from each other in the manner illustrated.

On the other hand, in a case where the same small dot can be formed by jetting ink drops having different velocities, two small dots can be formed in exact superposition, as illustrated in FIG. 24B. This will be described below in greater detail.

In an ink-jet head having nozzles of the kind shown in FIG. 7, the same small dot can be formed even if heater A 607 or heater B 609 is driven. However, in a case where the heater A 607 nearer the orifice 1*a* is driven, the velocity of the ink drop jetted from the orifice la is higher than would be the case if the heater B 609 located deeper within the nozzle were driven. Accordingly, when a dot in the frame 240 of FIG. 24B is formed, first the heater B 609 is heated at the timing at which a dot is formed in the frame 240 by driving the heater B 609, thereby jetting a small ink drop for forming a small dot, then the heater A 607 is heated by driving the heater A 607, thereby jetting a small ink drop for forming a small dot at the frame 240. In this case, the velocity of the ink drop jetted by driving the heater A 607 is greater than the velocity of the ink drop in the case where the heater B 609 is driven. Consequently, the ink drop jetted by driving the heater A 607 catches up with the ink drop jetted by heating the heater B 609 driven first. As a result, the two small dots overlap exactly and are formed as one large dot in the manner illustrated in FIG. 24B.

Thus, in accordance with the second embodiment, ink drops of approximately the same amount of ink are jetted toward a pixel position to form a dot. As a result, dot diameter is enlarged by a plurality of dots and the area factor (AF) of the pixel can be made more than 100%.

Third Embodiment

A third embodiment will be described in regard to an example in which the dot positions of large, medium and small dots are made the same in a case where large, medium and small dots are formed as described in the case of the nozzles of FIGS. 23A through 23C.

Figure 25:
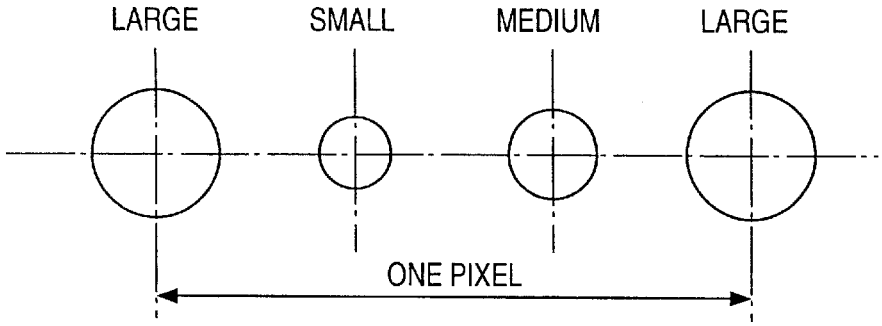
FIG. 25 is a diagram showing the positional relationship among large, medium and small dots according to a third embodiment of the invention.

FIG. 25 illustrates large, medium and small dots formed by dividing a print timing of one pixel into three approximately equal intervals. Here a case will be considered in which the three large, medium and small dots are formed at approximately the same position.

(1) When a small dot and a medium dot are formed at the same position

Let V3 represent the velocity at which an ink drop for forming a small dot is jetted from the head, and let V2 (>V3) represent the velocity at which an ink drop for forming a medium dot is jetted from the head. Since the spacing between the medium and small dots is one-third of a pixel, then we have the following relation from Equation (1) above:

$$f\cdot L\cdot(1/V3-1/V2)=1/3 \text{ (pixel)}$$

where f represents the driving frequency of the head and L represents the spacing between the nozzle tip and the recording paper.

If $V2=\alpha\cdot V3$ ($\alpha>1$) holds, then we have $$3\cdot f\cdot L\cdot(1/V3-1/\alpha V3)=3\cdot f\cdot L(\alpha-1)/\alpha V3=1$$

This gives us $$f\cdot L/V3=\alpha/3\ (\alpha-1) \qquad \text{Eq. (2)}$$

If f=7 kHz, L=1 mm and V3=6 m/s hold, then we have $\alpha\approx1.4$. At such time $V2\approx8.4$ (m/s) holds.

(2) When a small dot and a large dot are formed at the same position

Let V3 represent the velocity at which an ink drop for forming a small dot is jetted from the head, and let V1 (>V3 represent the velocity at which an ink drop for forming a large dot is jetted from the head. Since the spacing between the large and small dots is two-thirds of a pixel, then we have the following relation from Equation (1) above:

$$f\cdot L\cdot(1/V3-/V1)=2/3 \text{ (pixel)}$$

where f represents the driving frequency of the head and L represents the spacing between the nozzle tip and the recording paper.

If $V1=\beta\cdot V3$ ($\beta>1$) holds, then we have $$3\cdot f\cdot L\cdot(1/V3-1/\beta V3)=3\cdot f\cdot L(\beta-1)/\beta V3=2$$

This gives us $$f\cdot L/V3=2\beta/3\ (\beta-1) \qquad \text{Eq. (3)}$$

If f=7 kHz, L=1 mm and V3=6 m/s hold, in a manner similar to that above, then we have $\beta\approx2.33$. At such time $V1\approx14$ (m/s) holds.

Accordingly, the large, medium and small dots will be superposed and formed at the same position if the jetted velocity V3 of an ink drop (about 15 pl) for forming a small dot is made 6 m/s, the jetted velocity V2 of an ink drop (about 25 pl) for forming a medium dot is made 8.4 m/s and the jetted velocity V1of an ink drop (about 25 pl) for forming a large dot is made 14 m/s under the conditions f=7 kHz, L=1 mm.

The following equation holds in view of Equations (2), (3) above:

$$\alpha/(\alpha-1)=2\beta/(\beta-1)$$

Thus it will be understood that if the relation $\alpha\cdot\beta+\alpha-2\beta=0$ is satisfied, the three large, medium and small dots can be formed in superposition at the same position.

By thus forming dots of three different sizes in overlapping form at the same position, a tone pixel can be expressed by each of the large, medium and small dots individually and by combining the small and medium dots, the small and large dots and the medium and large dots. As a result, the tone of pixel data expressed by multiple levels can be reproduced at much higher quality.

The present invention provides outstanding effects with a print head and recording apparatus of the ink-jet recording type, especially of the kind that utilizes thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatuses. In the case of the on-demand type, at least one drive signal, which provides a sudden temperature rise that exceeds that for film boiling, is applied, in accordance with recording information, to an electrothermal transducer arranged to correspond to a sheet or fluid passageway holding a fluid (ink). As a result, thermal energy is produced in the electrothermal transducer to bring about film boiling on the thermal working surface of the print head. Accordingly, air bubbles can be formed in the fluid (ink) in one-to-one correspondence with the drive signals. Owing to growth and contraction of the air bubbles, the fluid (ink) is jetted via an orifice so as to form at least one droplet. If the drive signal has the form of a pulse, growth and contraction of the air bubbles can be made to take place rapidly and in appropriate fashion. This is preferred since it will be possible to achieve fluid (ink) discharge exhibiting excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the orifice, fluid passageway and electrothermal transducer (in which the fluid passageway is linear or right-angled) disclosed as the construction of the print head in each of the above-mentioned specifications, an arrangement using the art described in the specifications of U.S. Pat. Nos. 4,558,333 and 4,459,600, which disclose elements disposed in an area in which the thermal working portion is curved, may be employed. Further, it is possible to adopt an arrangement based upon Japanese Patent Application Laid-Open No. 59-123670, which discloses a configuration having a common slot for the ink discharge portions of a plurality of electrothermal transducers, or Japanese Patent Application Laid-Open No. 59-138461, which discloses a configuration having openings made to correspond to the ink discharge portions, wherein the openings absorb pressure waves of thermal energy.

As a print head of the full-line type having a length corresponding to the maximum width of the recording medium capable of being printed on by the recording apparatus, use can be made of an arrangement in which the length is satisfied by a combination of plural print heads of the kind disclosed in the foregoing specifications, or an arrangement in which recording heads serve as a single integrally formed recording head.

The print head may be of the replaceable chip-type, in which the connection to the apparatus and the supply of ink from the apparatus can be achieved by mounting the head on the apparatus, or of the cartridge type, in which the head itself is integrally provided with an ink tank.

In order to achieve the effects of the present invention more stably, it is preferred that the recording apparatus of the present invention be additionally provided with recovery means and preparatory auxiliary means for the print head. Specific examples are print head capping means, print head cleaning means, print head pressurizing or suction means, print head preheating means comprising an electrothermal transducer, or a heating element separate from this transducer or a combination of the transducer and the heating element, and a preliminary discharge mode for performing a discharge of ink separate from a discharge for recording purposes. These expedients are effective in achieving stable recording.

The recording mode of the recording apparatus is not limited to a recording mode solely for the mainstream colors such as black and white. The apparatus adopted can be one equipped with at least one recording head for a plurality of different colors or one full-color print head using mixed colors, though it is desired that this be achieved by a print head having an integrated structure or by a combination of a plurality of print heads.

Further, ink has been described as the fluid in the foregoing embodiments of the present invention. The ink used may be one which solidifies at room temperature or lower, one which softens at room temperature or one which is a liquid at room temperature. In general, temperature control is performed in such a manner that ink viscosity will fall within a stable ink jetting range by adjusting the temperature of the ink itself so as to fall within a temperature range of no less than 30° C. to no greater than 70° C. Accordingly, it will suffice to use an ink liquefied when the printing signal is applied.

In order to positively prevent elevated temperature due to thermal energy by using this as the energy for converting the ink from the solid state to the liquid state, or in order to prevent evaporation of the ink, it is permissible to use an ink which solidifies when left standing but which is liquefied by application of heat. In any case, ink which is liquefied for the first time by thermal energy, such as an ink liquefied by application of thermal energy conforming to a printing signal and jetted as a liquid ink, or ink which has already begun to solidify at the moment it reaches the recording medium, can be applied to the present invention. In the present invention, the most effective method of dealing with these inks is the above-described method of film boiling.

The recording apparatus of the present invention may take on the form of an apparatus that is an integral part of or separate from an image output terminal of information processing equipment such as a computer, a copier in combination with a reader or the like, or a facsimile machine having a transmitting/receiving function.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the present invention can also be achieved by providing a storage medium storing the program codes of the software for performing the aforesaid functions of the foregoing embodiments to a system or an apparatus, reading the program codes with a computer (e.g., a CPU or MPU) of the system or apparatus from the storage medium, and then executing the program.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, the present invention covers a case where an operating system or the like working on the computer performs a part of or the entire process in accordance with the designation of program codes and implements the functions according to the embodiment.

The present invention further covers a case where, after the program codes read from the storage medium are written in a function extension board inserted into the computer or in a memory provided in a function extension unit connected to the computer, a CPU or the like contained in the function extension board or function extension unit performs a part of or the entire process in accordance with the designation of program codes and implements the function of the above embodiments.

In the embodiments set forth above, examples in which recording is performed by scanning a print head are described. However, the invention is applicable also to an arrangement in which printing is performed using a full-line head, in which case the recording medium is moved.

In accordance with the embodiments of the present invention described above, dots of a plurality of sizes can be formed on a recording medium even by a single scan through a very simple arrangement.

Furthermore, the average printing ratio every scan of the head becomes an average value for each individual nozzle and it is possible to reduce the rate of errors such as ink discharge defects caused by printing at a high ratio. More specifically, since the amount of jetted ink is varied continuously for every nozzle, the average amount of jetted ink per nozzle declines even in a case where the printing ratio is high. As a result, it is possible to improve the refill frequency and improve upon the error rate. Furthermore, it is possible to lower momentary power, power supply cost can be reduced greatly and it is possible to prevent a decline in throughput caused by use of a power monitor or the like.

Further, in accordance with the embodiments, a small ink drop having a low jetted velocity is jetted to perform printing before a large ink drop having a high velocity when printing is carried out by moving a print head and a recording medium relative to each other. As a result, large and small ink drops constituting one pixel are formed on the recording medium in substantial superposition. This makes it possible to print a high-quality image in which the occurrence of texture and the like is suppressed.

Further, in accordance with these embodiments, a tone image that conforms to the density of ink used can be printed by changing the method of the driving the print head in dependence upon the density of the ink used for printing.

The present invention is not limited to the above embodiments and various changes and modifications can be made within the spirit and scope of the present invention. Therefore, to apprise the public of the scope of the present invention, the following claims are made.

What is claimed is:

1. An ink-jet printing apparatus in which ink jetted from an ink nozzle of a print head is made to adhere to a recording medium to form a pixel on the recording medium, comprising:

scanning means for scanning the print head or the recording medium to effect relative movement of the print head and the recording medium; and drive means being capable of successively jetting at least two inks of mutually different velocities from one ink nozzle at prescribed timings in accordance with scanning by said scanning means in order to form one pixel, wherein the ink of lower velocity is ejected first in the prescribed timings and the ink of higher velocity is ejected later in the prescribed timings, wherein a distance between the ink nozzle and the recording medium, the prescribed timings at which the at least two inks are jetted and the velocities at which the at least two inks are jetted are set to satisfy a predetermined relationship in order that the at least two inks successively jetted from the one nozzle by said drive means at the prescribed timings will adhere to the recording medium within the one pixel.

2. The apparatus according to claim 1, further comprising altering means for making different the jetted amounts of the at least two inks successively jetted from the one nozzle by the drive means at the prescribed timings, said altering means making the jetted amounts of the at least two inks different in order to form a comparatively large dot and a comparatively small dot.

3. The apparatus according to claim 2, wherein the velocity of the ink that forms the comparatively large dot is higher than the velocity of the ink that forms the comparatively small dot.

4. The apparatus according to claim 3, wherein an ink drop for forming the comparatively small dot is jetted before an ink drop for forming the comparatively large dot in regard to a certain pixel.

5. The apparatus according to claim 3, wherein a jetting frequency f at which ink is jetted to form dots of the same size, spacing L between the ink nozzle and the recording medium and jetting velocities V1, V2 (V1>V2) at which ink is jetted to form the dots having the different sizes are related as follows:

$$0<f\cdot L\cdot(V1-V2)/V1\cdot V2<1.0.$$

6. The apparatus according to claim 2, wherein a plurality of heating resistors which produce different amounts of heat from one another are provided to correspond to the ink nozzle, and said altering means actuates said heating resistors successively or simultaneously at a prescribed timing.

7. The apparatus according to claim 6, further comprising:

identifying means for identifying a type of ink used by the print head; and drive control means for changing a driving method of each of the plurality of heating resistors in dependence upon results of identification made by said identifying means.

8. The apparatus according to claim 2, wherein a plurality of heating resistors are provided at different positions to correspond to the ink nozzle, said altering means actuates heating resistors in different numbers or at different positions at a prescribed timing.

9. The apparatus according to claim 8, further comprising:

identifying means for identifying a type of ink used by the print head; and drive control means for changing a driving method of each of the plurality of heating resistors in dependence upon results of identification made by said identifying means.

10. The apparatus according to claim 1, further comprising:

converting means for converting multilevel recording data to modulated recording data based upon modulating data; and memory means for storing the modulating data, the modulating data being rewritable.

11. The apparatus according to claim 10, further comprising:

recording-scan data creating means for dividing the modulated recording data into data corresponding to each recording scan, and changing the divided data based upon the modulating data to create data corresponding to each recording scan; and multiple-pass control means for performing recording by a plurality of recording scans based upon the recording data that has been created by said recording-scan data creating means.

12. The apparatus according to claim 1, wherein said print head is a print head for jetting ink by utilizing thermal energy, said print head having a thermal energy generating body for generating thermal energy applied to the ink.

13. An ink-jet printing method in which ink jetted from an ink nozzle of a print head is made to adhere to a recording medium to form a pixel on the recording medium, comprising the steps of:

scanning the print head or the recording medium to effect relative movement of the print head and the recording medium; and successively jetting at least two inks of mutually different velocities from one ink nozzle of the print head at prescribed timings in accordance with scanning, in order to form a plurality of dots which form one pixel, wherein the ink of lower velocity is ejected first in the prescribed timings and the ink of higher velocity is ejected later in the prescribed timings, wherein a distance between the ink nozzle and the recording medium, the prescribed timings at which the at least two inks are jetted and the velocities at which the at least two inks are jetted are set to satisfy a predetermined relationship in order that the at least two inks successively jetted from the one ink nozzle in said jetting step at the prescribed timings will adhere to the recording medium within the one pixel.

14. The method according to claim 13, further comprising an altering step of making different the jetted amounts of the at least two inks successively jetted from the one nozzle at the prescribed timings, said altering step making the jetted amounts of the at least two inks different in order to form a comparatively large dot and a comparatively small dot.

15. The method according to claim 14, wherein the velocity of the ink that forms the comparatively large dot is higher than the velocity of the ink that forms the comparatively small dot.

16. The method according to claim 15, wherein an ink drop for forming the comparatively small dot is jetted before an ink drop forming the comparatively large dot in regard to a certain pixel.

17. The method according to claim 15, wherein a jetting frequency f at which ink is jetted to form dots of the same size, spacing L between the nozzle of the print head and the recording medium and jetting velocities V1, V2 (V1>V2) at which ink is jetted to form the dots having the different sizes are related as follows:

$$0<f\cdot L\cdot(V1-V2)/V1\cdot V2<1.0.$$

18. The method according to claim 14, wherein a plurality of heating resistors which produce different amounts of heat from one another are provided to correspond to the ink nozzle, and said altering step actuates said heating resistors successively or simultaneously at a prescribed timing.

19. The method according to claim 18, further comprising:

a step of identifying a type of ink used by the print head; and a step of changing a driving method of each of the plurality of heating resistors in dependence upon results of identification.

20. The method according to claim 14, wherein a plurality of heating resistors are provided at different positions to correspond to the ink nozzle, said altering step actuates heating resistors in different numbers or at different positions at a prescribed timing.

21. The method according to claim 20, further comprising:

a step of identifying a type of ink used by the print head; and a step of changing a driving method of each of the plurality of heating resistors in dependence upon results of identification.

22. The method according to claim 13, further comprising:

a converting step of converting multilevel recording data to modulated recording data based upon modulating data; and a step of storing the modulating data, the modulating data being rewritable.

23. The method according to claim 22, further comprising:

a recording-scan data creating step of dividing the recording data into data corresponding to each recording scan, and changing the divided data based upon the modulating data to create data corresponding to each recording scan; and a multiple-pass control step of performing recording by a plurality of scans based upon the recording data that has been created by said record-scan data creating step.

24. An ink-jet printing apparatus in which ink jetted from an ink nozzle of a print head is made to adhere to a recording medium to form a pixel on the recording medium comprising:

scanning means for scanning the print head or the recording medium to effect relative movement of the print head and the recording medium; and drive means being capable of successively jetting at least two inks of mutually different velocities from the one ink nozzle at prescribed timings while scanning by said scanning means in order to form one pixel; and control means for controlling to first jet an ink of relatively low velocity of the at least two inks.

25. The apparatus according to claim 24, wherein the ink of relatively low velocity is an ink of relatively small amount of jetted ink.

26. An ink-jet printing method in which ink jetted from an ink nozzle of a print head is made to adhere to a recording medium to form a pixel on the recording medium, comprising the steps of:

scanning the print head or the recording medium to effect relative movement of the print head and the recording medium;

successively jetting at least two inks of mutually different velocities from the one ink nozzle at prescribed timings while scanning, in order to form one pixel; and controlling to first jet an ink of relatively low velocity of the at least two inks.

27. The method according to claim 26, wherein the ink of relatively low velocity is an ink of relatively small amount of jetted ink.

* * * * *

UNITED STATES PATENT AND TRADEMARK OFFICE

CERTIFICATE OF CORRECTION

PATENT NO. : 6,312,096 B1
DATED : November 6, 2001
INVENTOR(S) : Koitabashi et al.

It is certified that error appears in the above-identified patent and that said Letters Patent is hereby corrected as shown below:

Title page,
Insert -- [*] Notice: This patent issued on a continued prosecution application filed under 37 CFR 1.53(d), and is subject to the twenty year patent term provisions of 35 U.S.C. 154(a)(2). --.

Column 11,
Line 40, "election" should read -- selection --.

Column 14,
Line 65, "The data" should not begin a new paragraph.

Figure 19:
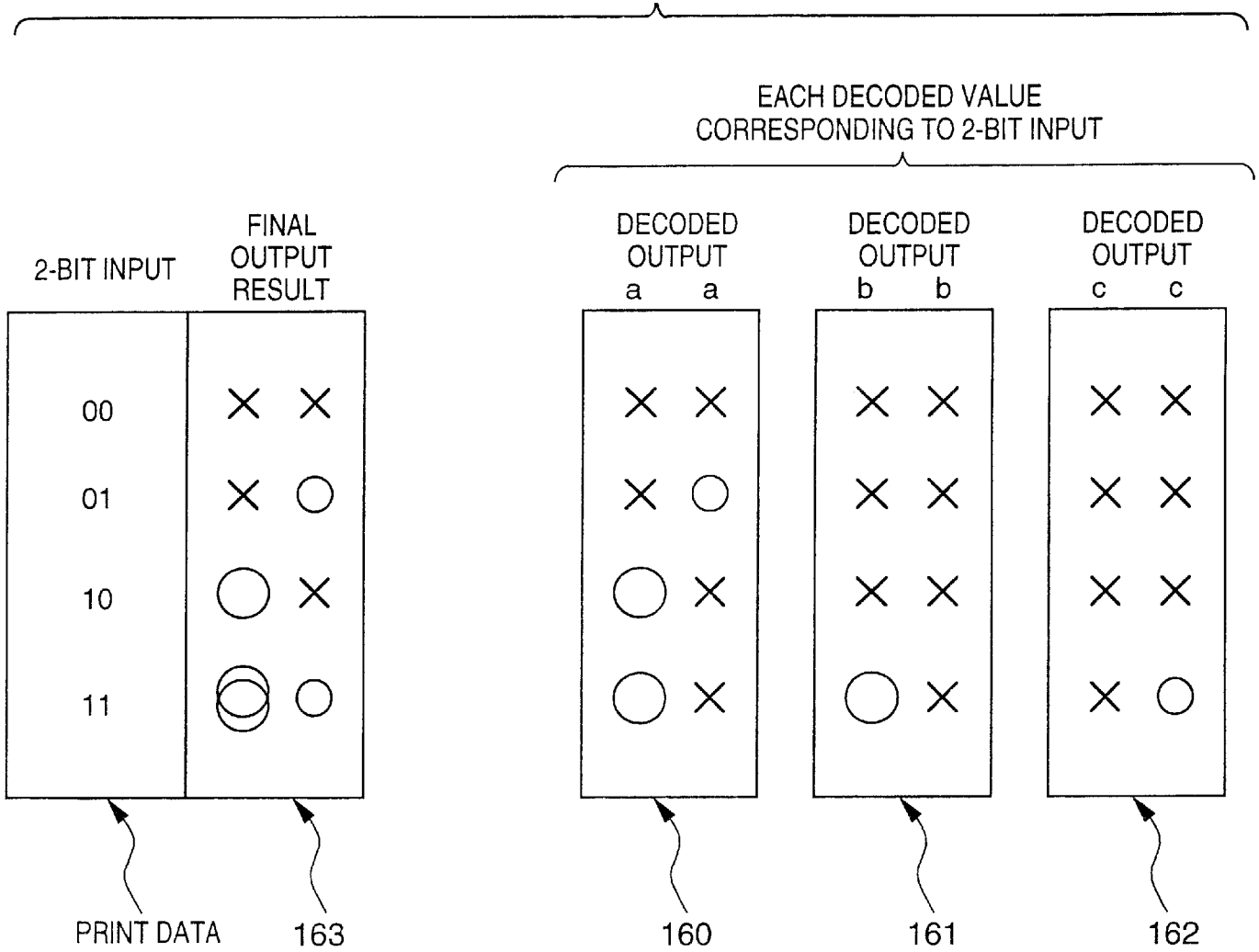
FIG. 19 is a diagram for describing an example of outputs obtained by decoding 2-bit print data in this embodiment.

Column 15,
Line 63, "10 FIG. 19." should read -- FIG. 19. --.

Column 16,
Line 1, "small 15" should read -- small --.

Signed and Sealed this

Thirtieth Day of April, 2002

*Attest:*

*Attesting Officer*

JAMES E. ROGAN
*Director of the United States Patent and Trademark Office*